US010415302B2

(12) United States Patent
Vander Bent, Jr. et al.

(10) Patent No.: US 10,415,302 B2
(45) Date of Patent: Sep. 17, 2019

(54) WINDOW SETTING BLOCK

(71) Applicant: PGT Innovations, Inc., North Venice, FL (US)

(72) Inventors: Kenneth John Vander Bent, Jr., Bradenton, FL (US); Michael Dietmar Nau, North Port, FL (US); Hong Chen, Sarasota, FL (US)

(73) Assignee: PGT Innovations, Inc., North Venice, FL (US)

( * ) Notice: Subject to any disclaimer, the term of this patent is extended or adjusted under 35 U.S.C. 154(b) by 0 days.

(21) Appl. No.: 16/035,952

(22) Filed: Jul. 16, 2018

(65) Prior Publication Data

US 2019/0211612 A1 Jul. 11, 2019

Related U.S. Application Data

(60) Provisional application No. 62/614,684, filed on Jan. 8, 2018.

(51) Int. Cl.
*E06B 3/54* (2006.01)
*E06B 3/58* (2006.01)

(52) U.S. Cl.
CPC ..... *E06B 3/5409* (2013.01); *E06B 3/5454* (2013.01); *E06B 3/5878* (2013.01); *E06B 2003/5472* (2013.01)

(58) Field of Classification Search
CPC .... E06B 3/5409; E06B 3/5454; E06B 3/5878; E06B 2003/5472; E06B 7/16; E06B 3/58
See application file for complete search history.

(56) References Cited

U.S. PATENT DOCUMENTS 2,612,663 A * 10/1952 Pearse ..... E06B 3/5409 52/126.3
3,155,205 A 11/1964 Place
3,238,685 A 3/1966 Emory
3,242,627 A 3/1966 Fountain
3,703,063 A * 11/1972 Budich ..... E06B 3/222 52/213
3,774,363 A * 11/1973 Kent ..... B60J 10/30 52/204.597
3,846,948 A 11/1974 Dallen
(Continued)

FOREIGN PATENT DOCUMENTS

EP 2450517 5/2012
EP 3246505 A1 * 11/2017 ..... E06B 3/26305
(Continued)

OTHER PUBLICATIONS

Tubelite Inc.; Article entitled: "Glass Stops", located at <https://web.archive.org/web/20141017115438/http:/www.tubeliteinc.com:80/glass-stops/>, publicly available as early as Oct. 17, 2014, 1 pgs.

*Primary Examiner* — Beth A Stephan
(74) *Attorney, Agent, or Firm* — Taylor English Duma LLP

(57) ABSTRACT

A window frame assembly includes a frame; a setting block including a block body secured to the frame; and a block lip extending outwards from the block body; a glazing bead secured to the frame and the setting block, a bead rib of the glazing bead positioned between the block lip and the frame, the glazing bead and the frame defining a glazing channel; and a lite defining a first edge, the first edge of the lite inserted into the glazing channel.

20 Claims, 21 Drawing Sheets

(56) References Cited

U.S. PATENT DOCUMENTS

| | | | | | |
|---|---|---|---|---|---|
| 4,040,219 | A * | 8/1977 | Budich | E06B 3/22 | 52/204.591 |
| 4,187,657 | A * | 2/1980 | Sukolics | E06B 3/12 | 49/DIG. 1 |
| 4,314,424 | A * | 2/1982 | Gordon | E06B 3/308 | 49/400 |
| 4,447,985 | A * | 5/1984 | Weber | E06B 3/308 | 49/400 |
| 4,614,062 | A * | 9/1986 | Sperr | E06B 3/26303 | 49/401 |
| 4,628,648 | A * | 12/1986 | Winyard | E06B 3/26338 | 49/505 |
| 4,852,312 | A * | 8/1989 | Harbom | E06B 3/5409 | 52/126.3 |
| 5,044,121 | A * | 9/1991 | Harbom | E06B 3/325 | 49/401 |
| 5,410,846 | A * | 5/1995 | Frambach | E06B 3/308 | 49/400 |
| 5,950,379 | A | 9/1999 | Moore et al. | | |
| 6,679,013 | B2 | 1/2004 | Hornung | | |
| 8,484,902 | B1 * | 7/2013 | Brown | E06B 3/308 | 49/401 |
| 8,621,793 | B2 | 1/2014 | Abdul Lathief | | |
| 2004/0231255 | A1 | 11/2004 | Silverman | | |
| 2018/0163458 | A1 * | 6/2018 | Header | E06B 7/14 | |

FOREIGN PATENT DOCUMENTS

| | | |
|---|---|---|
| GB | 448743 | 6/1936 |
| GB | 1271522 | 4/1972 |
| GB | 2292170 | 7/1997 |

* cited by examiner

WINDOW SETTING BLOCK

CROSS-REFERENCE TO RELATED APPLICATIONS

This application claims the benefit of U.S. Provisional Application No. 62/614,684, filed on Jan. 8, 2018, which is hereby incorporated by reference in its entirety.

TECHNICAL FIELD

This disclosure relates to glazing and window frames. More specifically, this disclosure relates to a setting block and a glazing bead.

BACKGROUND

Windows commonly utilize setting blocks which are placed between the glazing, or the lite, of the window and the frame to prevent contact between the lite and the frame that can result in stress on the lite. If the window is assembled without setting blocks, the lite may prematurely fail in service. Additionally, improper installation of glazing beads can place stress upon the lite which can also result in failure during service or assembly.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a window frame assembly comprising a frame; a setting block comprising a block body secured to the frame; and a block lip extending outwards from the block body; a glazing bead secured to the frame and the setting block, a bead rib of the glazing bead positioned between the block lip and the frame, the glazing bead and the frame defining a glazing channel; and a lite defining a first edge, the first edge of the lite inserted into the glazing channel.

Also disclosed is a method for assembling a window frame assembly, the method comprising securing a setting block of the window frame assembly to a frame of the window frame assembly; and securing a glazing bead of the window frame assembly to the setting block and to the frame.

Also disclosed is a window frame assembly comprising a frame; and a setting block, the setting block configured to engage the frame.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
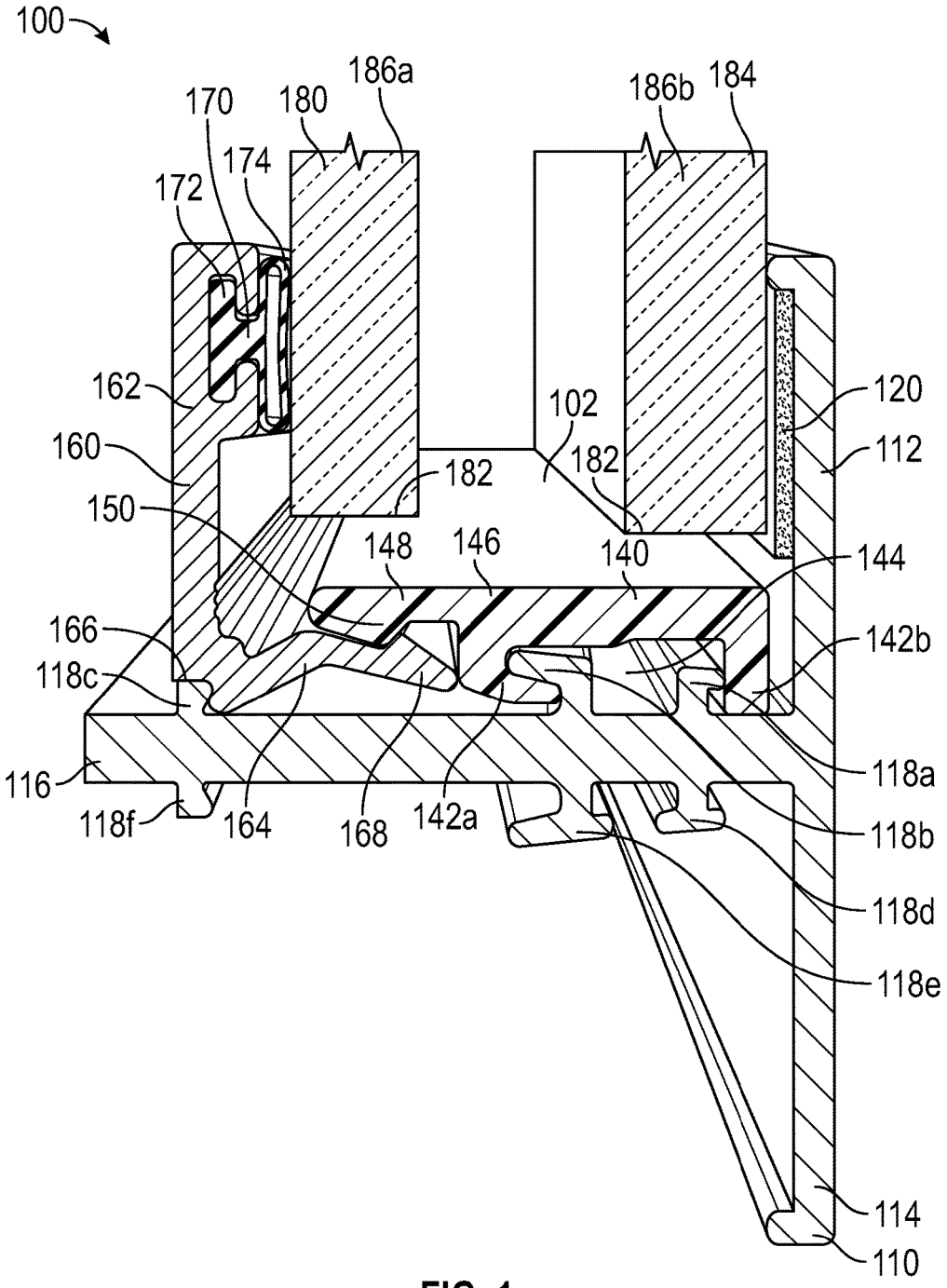
FIG. 1 is a detailed cross-sectional view of a window frame assembly comprising a frame, a setting block, a glazing bead, and a lite in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a window frame assembly and associated methods, systems, devices, and various apparatus. The window frame assembly can comprise a frame, a setting block, a glazing bead, and a lite. It would be understood by one of skill in the art that the disclosed window frame assembly is described in but a few exemplary aspects among many. No particular terminology or description should be considered limiting on the disclosure or the scope of any claims issuing therefrom.

FIG. 1 is a detailed cross-sectional view of a window frame assembly 100 comprising a frame 110, a setting block 140, a glazing bead 160, and a lite 180 in accordance with one aspect of the present disclosure. In the present aspect, the frame 110 can be a fixed frame 112 configured to directly receive the lite 180. In other aspects, the frame 110 can be a stile or a rail of an operable sash, as shown and described in further detail below with respect to FIGS. 11-20. In the present aspect, each of the frame 110, the setting block 140, and the glazing bead 160 can be extrusions; however, in other aspects, any or all of the frame 110, the setting block 140, and the glazing bead 160 can be manufactured through a different process such as casting, for example and without limitation.

In the present aspect, the frame 110 can comprise a flange 114 and a web 116, and the web 116 can extend outwards from the flange 114 substantially perpendicular to the flange 114. The frame 110 can comprise a plurality of ribs 118*a-f* extending outwards from the web 116. The setting block 140 can comprise a plurality of ribs 142*a,b* extending outwards from a block body 146 of the setting block 140. The setting block 140 can define a setting block groove 144 extending along the block body 146 between the ribs 142*a,b*, and the setting block groove 144 can be configured to engage the ribs 118*a,b*, of the frame 110 to secure the setting block 140 to the frame 110.

The glazing bead 160 can comprise a bead body 162 and a bead rib 164, and the bead rib 164 can extend outwards from the bead body 162. In the present aspect, the bead body 162 and the bead rib 164 of the glazing bead 160 can substantially define an L-shape; however, in other aspects, the glazing bead 160 can define a different shape, such as a T-shape for example and without limitation. The bead rib 164 can be configured to slip underneath a block lip 148 of the setting block 140, and a bead barb 168 of the bead rib 164 can engage with a setting block barb 150 of the block lip 148 to secure the glazing bead 160 to the setting block 140. The glazing bead 160 can define a bead groove 166 proximate to an intersection between the bead body 162 and the bead rib 164, and the bead groove 166 can be configured to receive the rib 118*c* of the frame 110 to secure the glazing bead 160 to the setting block 140 and the frame 110.

The glazing bead 160 and the frame 110 can define a glazing channel 102, and the glazing channel 102 can receive a first edge 182 of the lite 180. In the present aspect, the lite 180 can be an insulating glass unit ("IGU") 184 comprising a first pane 186*a* and a second pane 186*b* spaced apart from one another; however, in other aspects, the lite 180 can be a different type of glazing, such as a single pane, laminated glass, or any other suitable type of glazing or infill. In the present aspect, the glazing bead 160 can comprise a bead weather strip 170 disposed within the glazing channel 102, and the bead weather strip 170 can be configured to engage and deform against the first pane 186*a* to form a seal between the glazing bead 160 and the lite 180. In the present aspect, the bead weather strip 170 can comprise a rubber material, and the bead weather strip 170 can define a flange portion 172 and a tubular portion 174. The flange portion 172 can be T-shaped in the present aspect, and the flange portion 172 can be captured by the glazing bead 160. The tubular portion 174 can engage the first pane 186*a*, and the tubular portion 174 can be configured to collapse and elastically deform to exert residual pressure against the lite 180.

The frame 110 can comprise a frame weather strip 120 disposed within the glazing channel 102, and the frame weather strip 120 can be configured to engage and form a seal with the second pane 186*b* of the lite 180. In the present aspect, the frame weather strip 120 can comprise neoprene rubber, and the frame weather strip 120 can be bonded to the flange 114 of the frame 110, such as with a glue, mastic, epoxy, or any other suitable adhesive. In some aspects, the frame weather strip 120 can be treated with an adhesive, and the frame weather strip 120 can also bond to the lite 180 to form a seal between the lite 180 and the frame 110.

The setting block 140 can be configured to prevent contact between the first edge 182 of the lite 180 and the web 116 of the frame 110 in order to reduce conduction of heat between the lite 180 and the frame 110 and to prevent stress risers along the first edge 182 of the lite 180 caused by thermal expansion and contraction of the lite 180. In some applications, such as along a bottom rail of a sash, the setting block 140 can support the weight of the lite 180. In other applications, such as along a stile of a sash, a gap may be defined between the lite 180 and the setting block 140 to allow for thermal expansion of the lite 180, as shown.

Figure 2:
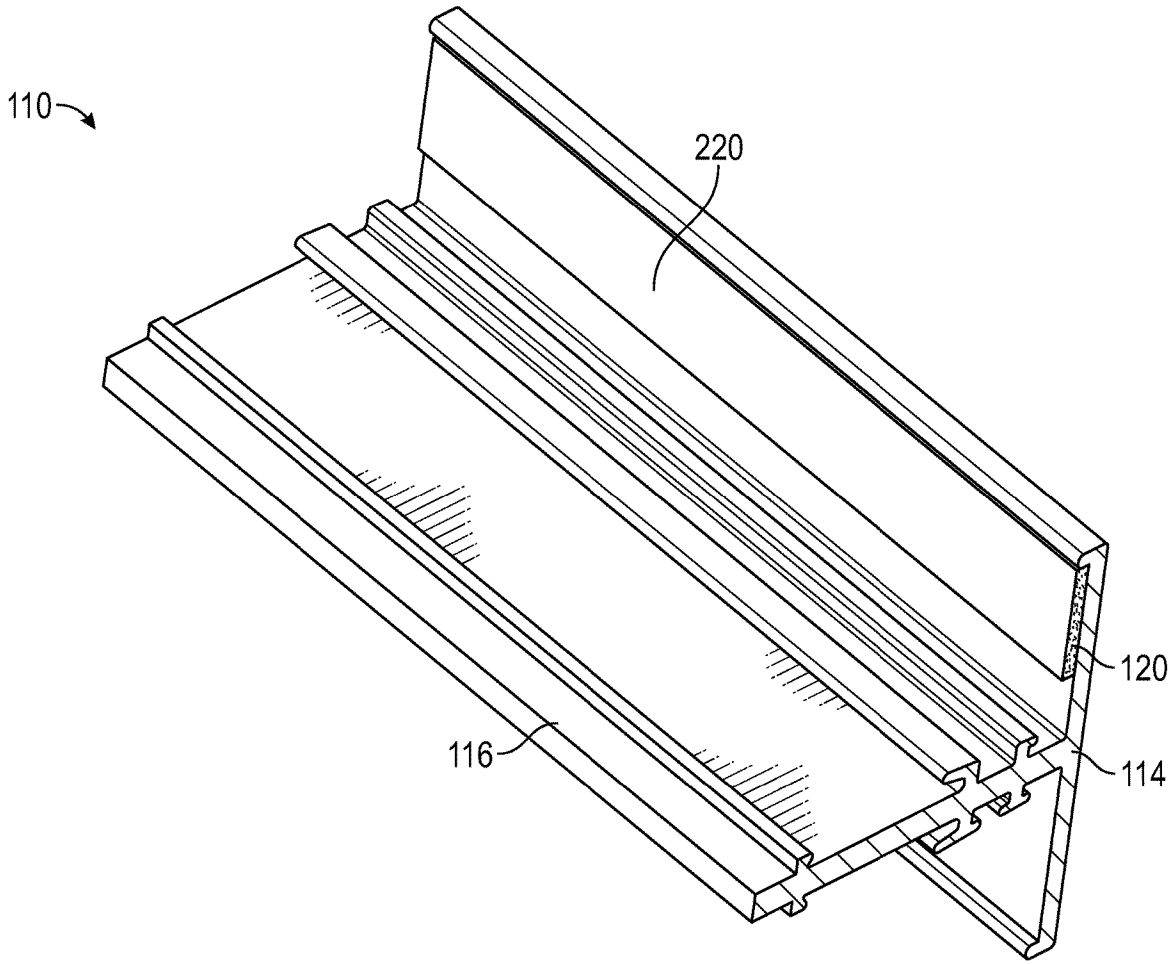
FIG. 2 is a perspective view of the frame of FIG. 1.

FIG. 2 is a perspective view of the frame 110 of FIG. 1. In the aspect shown, the frame weather strip 120 can be covered by a backing strip 220. The backing strip 220 can cover and protect an adhesive coating applied to the frame weather strip 120. By removing the backing strip 220, the adhesive coating can be exposed in order to bond the frame weather strip 120 to the lite 180 as shown in FIG. 1.

Figure 3:
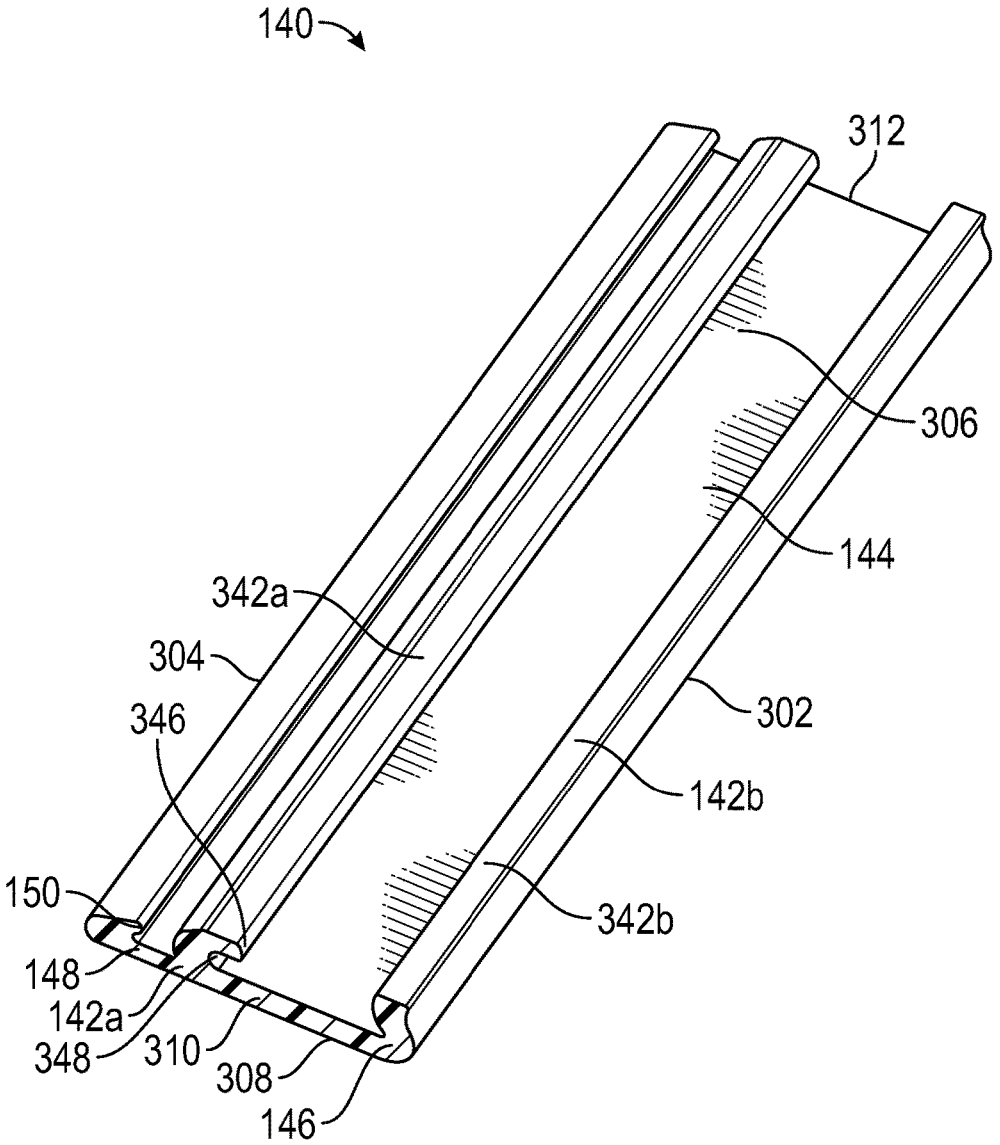
FIG. 3 is a perspective view of the setting block of FIG. 1.

FIG. 3 is a perspective view of the setting block 140 of FIG. 1. The block body 146 can define a first end 310 and a second end 312 disposed opposite from the first end 310. In the present aspect, each of the ribs 142*a,b*, the setting block barb 150 and the setting block groove 144 can extend from the first end 310 to the second end 312. The block body 146 can also define a first edge 302 and a second edge 304 disposed opposite from the first edge 302. The rib 142*b* can be disposed at the first edge 302, and the setting block barb 150 can be disposed at the second edge 304. The block body 146 can also define a frame side 306 and a lite side 308 disposed opposite from the frame side 306. In the present aspect, each of the ribs 142*a,b* and the setting block barb 150 can extend outwards from the frame side 306 of the block body 146, and the setting block groove 144 can extend along the frame side 306. In the present aspect, the lite side 308 can be substantially planar; however, in other aspects, the lite side 308 can define a different shape, such as a grooved shape, a rounded shape, or any other suitable shape, for example and without limitation.

In the present aspect, the rib 142*a* can be a block toe rib 342*a*, and the rib 142*b* can be a block heel rib 342*b*. The block toe rib 342*a* can define a lip 346 which extends back towards the first edge 302 to partially enclose a toe pocket portion 348 of the setting block groove 144. In the present aspect, the block heel rib 342*b* can define a substantially rectangular cross-section; however in other aspects, the block heel rib 342*b* can define a lip extending towards the second edge 304, as shown and further described below with respect to FIG. 10. In other aspects, the block heel rib 342*b* can define a different cross-sectional shape, such as L-shaped, triangular, trapezoidal, C-shaped, or any other suitable shape, for example and without limitation.

Figure 4:
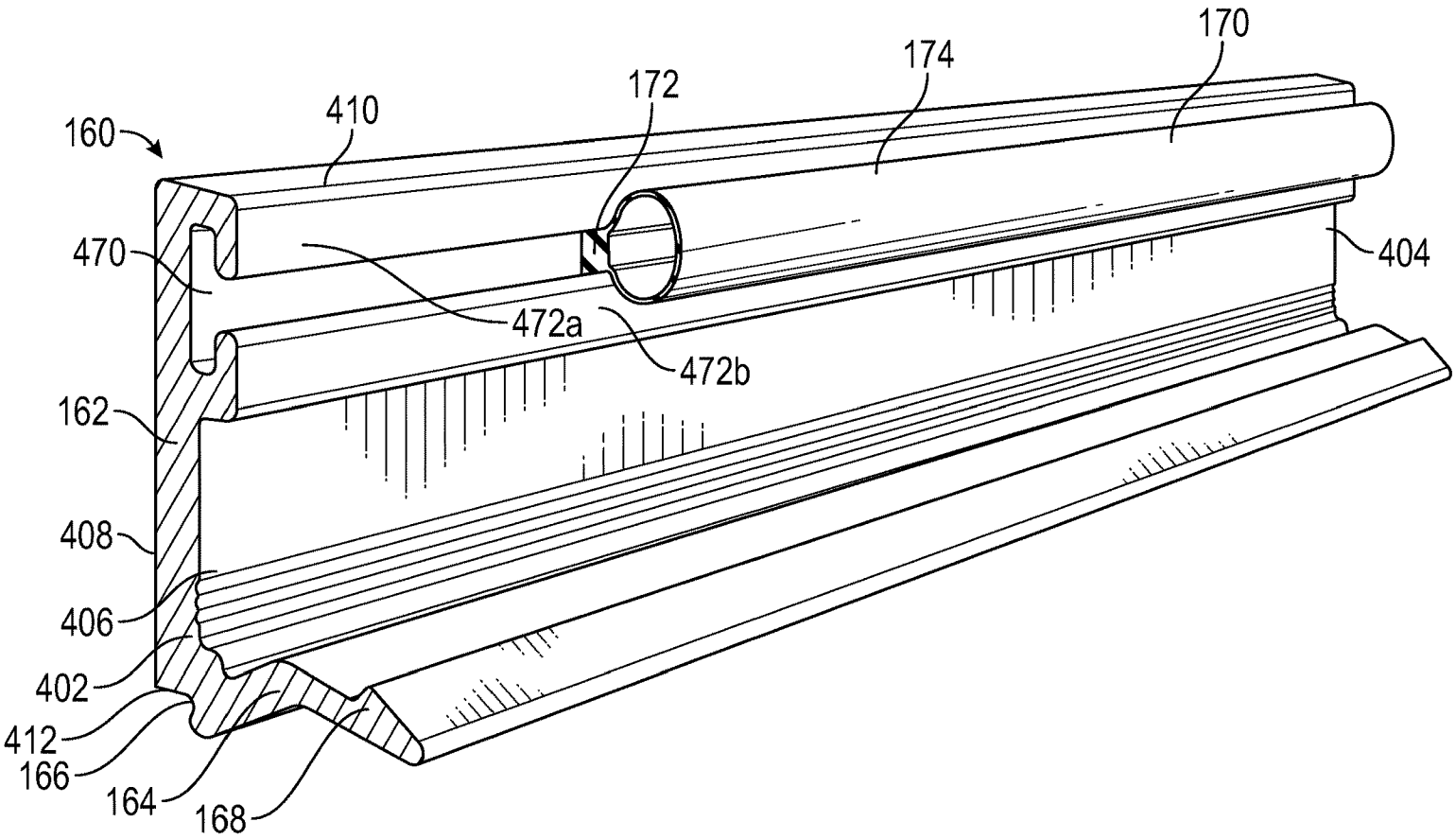
FIG. 4 is a perspective view of the glazing bead of FIG. 1.

FIG. 4 is a perspective view of the glazing bead 160 of FIG. 1. The bead body 162 can define a first end 402 and a second end 404 disposed opposite from the first end 402. In the present aspect, the bead rib 164 can extend along the bead body 162 from the first end 402 to the second end 404. The bead body 162 can also define a first edge 410 and a second edge 412 disposed opposite from the first edge 410. In the present aspect, the bead rib 164 can be disposed proximate to the second edge 412, and the bead groove 166 can be defined at the second edge 412. The bead body 162 can further define a first side 406 and a second side 408. The bead rib 164 can extend outwards from the first side 406 of the bead body 162, and the first side 406 can partially define the glazing channel 102, as shown in FIG. 1.

A pair of ribs 472*a,b* can also extend outwards from the first side 406, and the pair of ribs 472*a,b* can define a T-slot 470 configured to receive the flange portion 172 of the bead weather strip 170. In the present aspect, the bead weather strip 170 is shown partially slid out of the T-slot 470 towards the second end 404 of the bead body 162 to more clearly shows the details of the ribs 472*a,b* and the T-slot 470.

Figure 5:
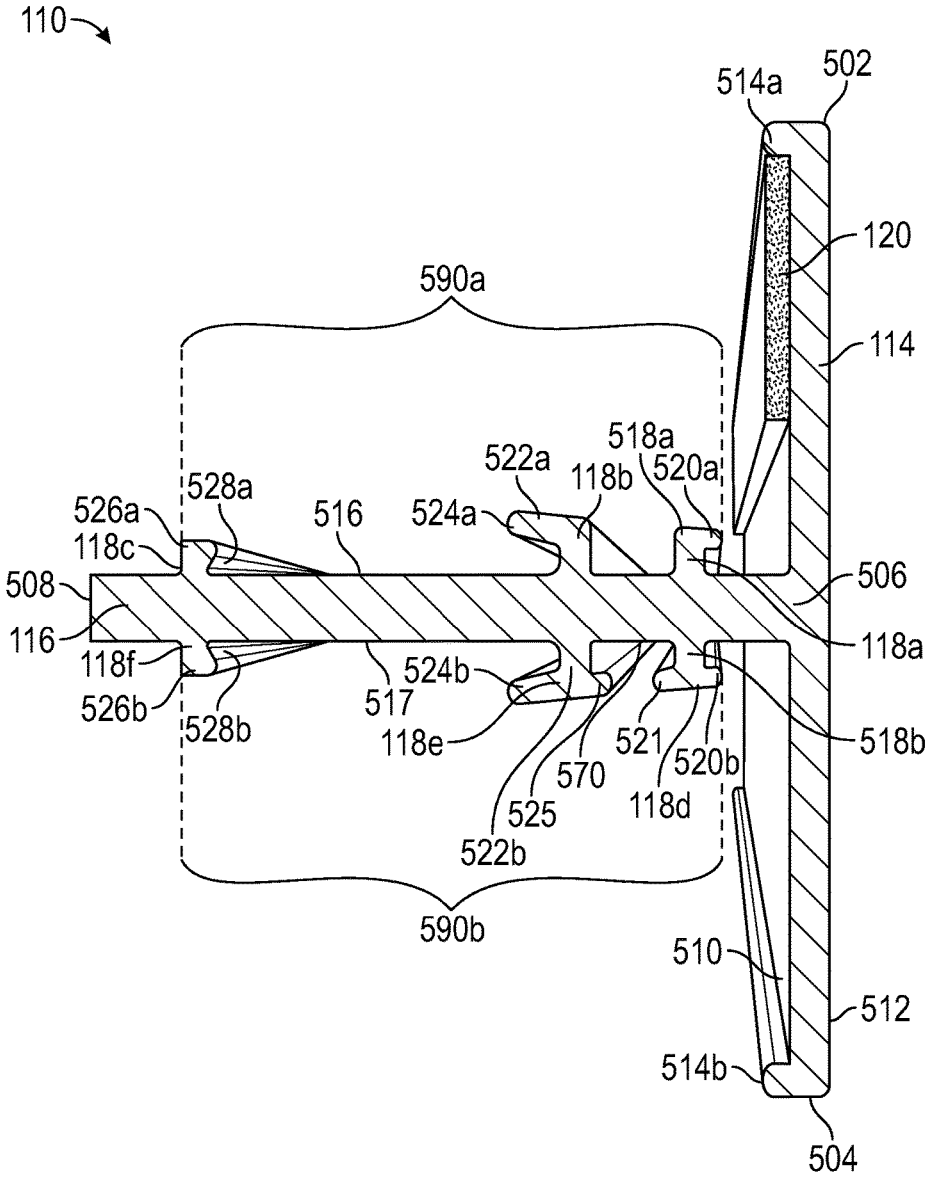
FIG. 5 is an end view of the frame of FIG. 1.

FIG. 5 is an end view of the frame 110 of FIG. 1. The flange 114 can define a first edge 502 and a second edge 504 disposed opposite from the first edge 502. The flange 114 can also define a first side 510 and a second side 512 disposed opposite from the first side 510. In the present aspect, the web 116 can extend outwards from the first side 510 of the flange 114, and the frame weather strip 120 can be attached to the first side 510. The flange 114 can also define a pair of lips 514*a,b* disposed at the first edge 502 and the second edge 504, respectively, and the lips 514*a,b* can extend outwards from the first side 510 of the flange 114.

The web 116 can define a first end 506 and a second end 508 disposed opposite from the first end 506. The first end 506 of the web 116 can be attached to the flange 114. The web 116 can also define a first side 516 and a second side 517. The first side 516 can face the first edge 502 of the flange 114, and the second side 517 can face the second edge 504 of the flange 114. The ribs 118*a-c* can extend outwards from the first side 516 of the web 116, and the ribs 118*d-f* can extend outwards from the second side 517 of the web 116. The ribs 118*a,d* can be positioned proximate to the first end 506 of the web 116. The ribs 118*c,f* can be positioned proximate to the second end 508 of the web 116.

The rib 118*b* can be disposed on the first side 516 between the ribs 118*a,c*. In the present aspect, the rib 118*b* can be a frame toe rib 522*a*, and in the present aspect, the frame toe rib 522*a* can define a lip 524*a* which can extend towards the second end 508 of the web 116. The rib 118*a* can be a frame heel rib 518*a*, and in the present aspect, the frame heel rib 518*a* can define a lip 520*a* extending towards the first end 506 of the web 116. In the present aspect, each of the frame toe rib 522*a* and the frame heel rib 518*a* can substantially define an L-shape. The frame toe rib 522*a* and the frame heel rib 518*a* can be configured to engage the block toe rib 342*a* and the block heel rib 342*b* (ribs 342*a,b* shown in FIG. 3) to secure the setting block 140 (shown in FIG. 3) to the frame 110, as shown and further described below in FIGS. 6 and 7. The rib 118*c* can be a bead clip 526*a* which can be configured to engage the bead groove 166 (shown in FIG. 1) to secure the glazing bead 160 (shown in FIG. 1) to the frame 110. In the present aspect, the bead clip 526*a* can define a substantially trapezoidal cross-sectional shape, and the bead clip 526*a* can be swept towards the first end 506 of the web 116 to define an acute groove 528*a*.

Together, the frame toe rib 522*a*, the frame heel rib 518*a*, and the bead clip 526*a* can define a frame detail geometry 590*a*. The frame detail geometry 590*a* can be defined by a framing member configured for mounting glazing, such as a stile or rail of a sash or fixed frame, or any other member. The ribs 118*d-f* can define a variation of the frame detail geometry 590*b*. The rib 118*f* can be a bead clip 526*b* which can be substantially similar to the bead clip 526*a*, and the bead clip 526*b* can define an acute groove 528*b* similar to the acute groove 528*a*. The rib 118*e* can be a frame toe rib 522*b* which can be similar to the frame toe rib 522*a*, and the frame toe rib 522*b* can define a lip 524*b* which can be substantially similar to the lip 524*a*. However, the frame toe rib 522*b* can further define a lip 525 extending towards the first end 506 of the web 116. Similarly, the rib 118*d* can be a frame heel rib 518*b* which can be similar to the frame heel rib 518*a*, and the frame heel rib 518*b* can define a lip 520*b* which can be substantially similar to the lip 520*a*. However, the frame heel rib 518*b* can further define a lip 521 extending towards the second end 508 of the web 116. In the present aspect, the frame heel rib 518*b* and the frame toe rib 522*b* can each substantially define a T-shape. The frame heel rib 518*b* and the frame toe rib 522*b* can additionally define a T-slot 570, similar to the T-slot 470 (shown in FIG. 4), and the frame heel rib 518*b* and the frame toe rib 522*b* can be configured to optionally mount a second setting block 140 (shown in FIG. 1) or to receive the flange portion 172 of a weather strip similar to the bead weather strip 170 (flange portion 172 and bead weather strip 170 shown in FIG. 4). This flexibility provided by the frame detail geometry 590*b* can be implemented into modular framing components which can improve manufacturing efficiency and flexibility.

Figure 6:
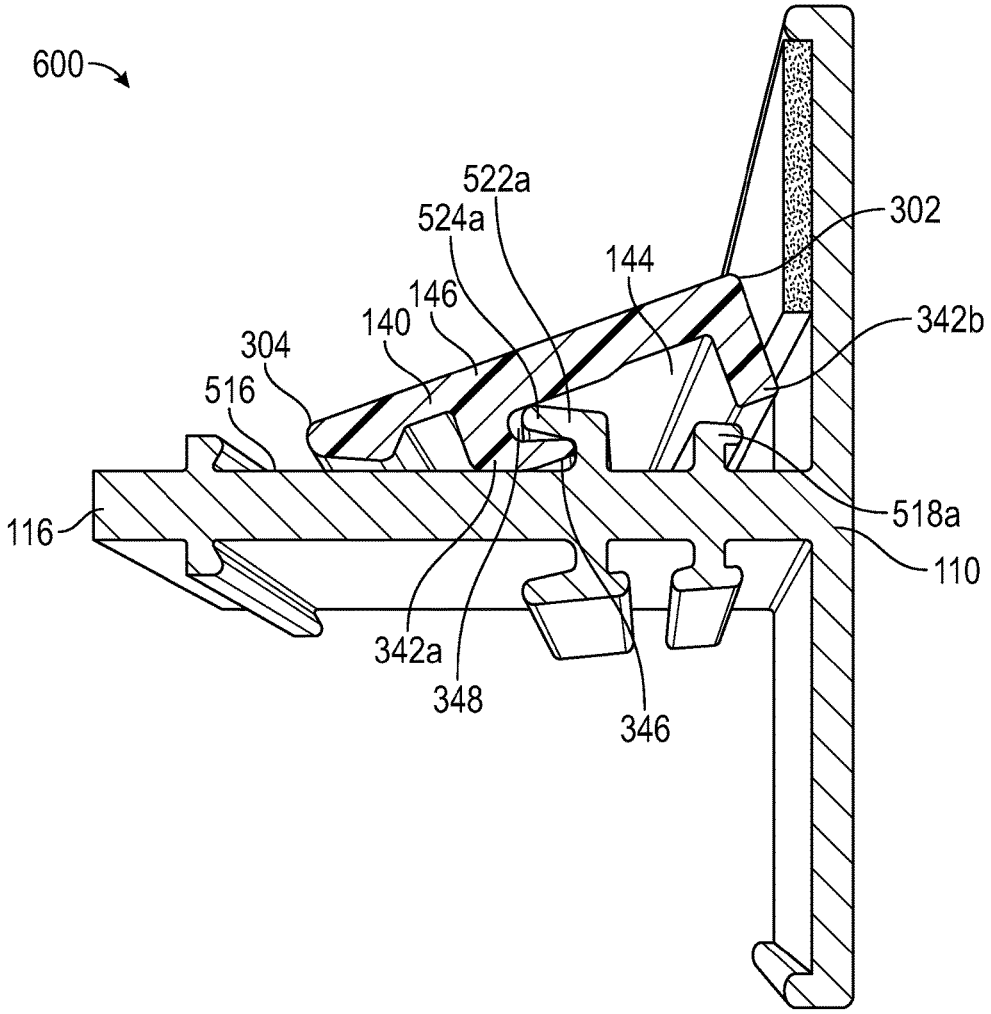
FIG. 6 is an end view demonstrating a first step of a method for assembling the window frame assembly of FIG. 1.

FIG. 6 is an end view demonstrating a first step 600 of a method for assembling the window frame assembly 100 of FIG. 1. In the first step 600, the setting block 140 can be angled relative to the first side 516 of the web 116 so that the second edge 304 of the block body 146 is positioned closer to the first side 516 than the first edge 302 of the block body 146. The frame toe rib 522*a* can then be inserted into the setting block groove 144, and the lip 524*a* can be inserted into the toe pocket portion 348 of the setting block groove 144 and engaged with the lip 346 of the block toe ridge 342*a* as shown.

Figure 7:
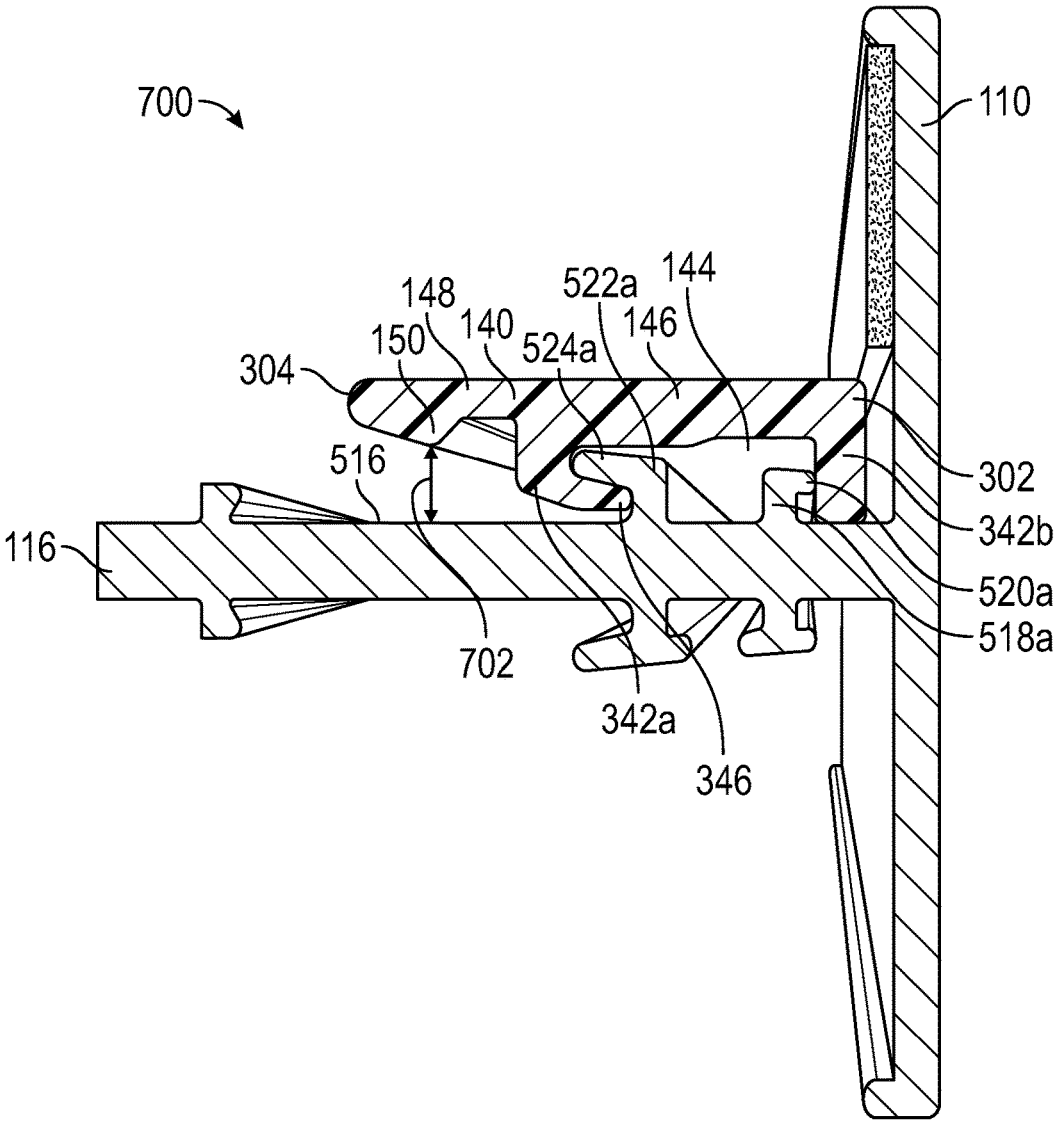
FIG. 7 is an end view demonstrating a second step of the method for assembling the window frame assembly of FIG. 1.

FIG. 7 is an end view demonstrating a second step 700 of the method for assembling the window frame assembly 100 of FIG. 1. Once the frame toe rib 522*a* is engaged with the block toe rib 342*a*, the first edge 302 of the block body 146 can be pivoted towards the first side 516 of the web 116 so that the frame heel rib 518*a* is inserted into the setting block groove 144 and engaged with the block heel rib 342*b*. The motion demonstrated in steps 600 and 700 can be similar to the motion of slipping a shoe onto a human foot wherein the setting block 140 is analogous to the shoe, and the frame toe rib 522*a* and frame heel rib 518*a* are analogous to the toe and heel of a human foot, respectively. Upon completion of the second step 700, the setting block 140 can be secured to the frame 110. In the present aspect, the setting block 140 can be sized to snap over the frame heel rib 518*a*; however, in other aspects, such as the aspect shown in FIG. 10, the block heel rib 342*b* can define a lip 1342 (shown in FIG. 10) which can engage the lip 520*a* so that the lip of the block heel rib 342*b* is positioned between the lip 520*a* and the first side 516 of the web 116. With the setting block 140 secured to the frame 110, a gap 702 can be defined between the setting block barb 150 of the block lip 148 and the first side 516 of the web 116.

Figure 8:
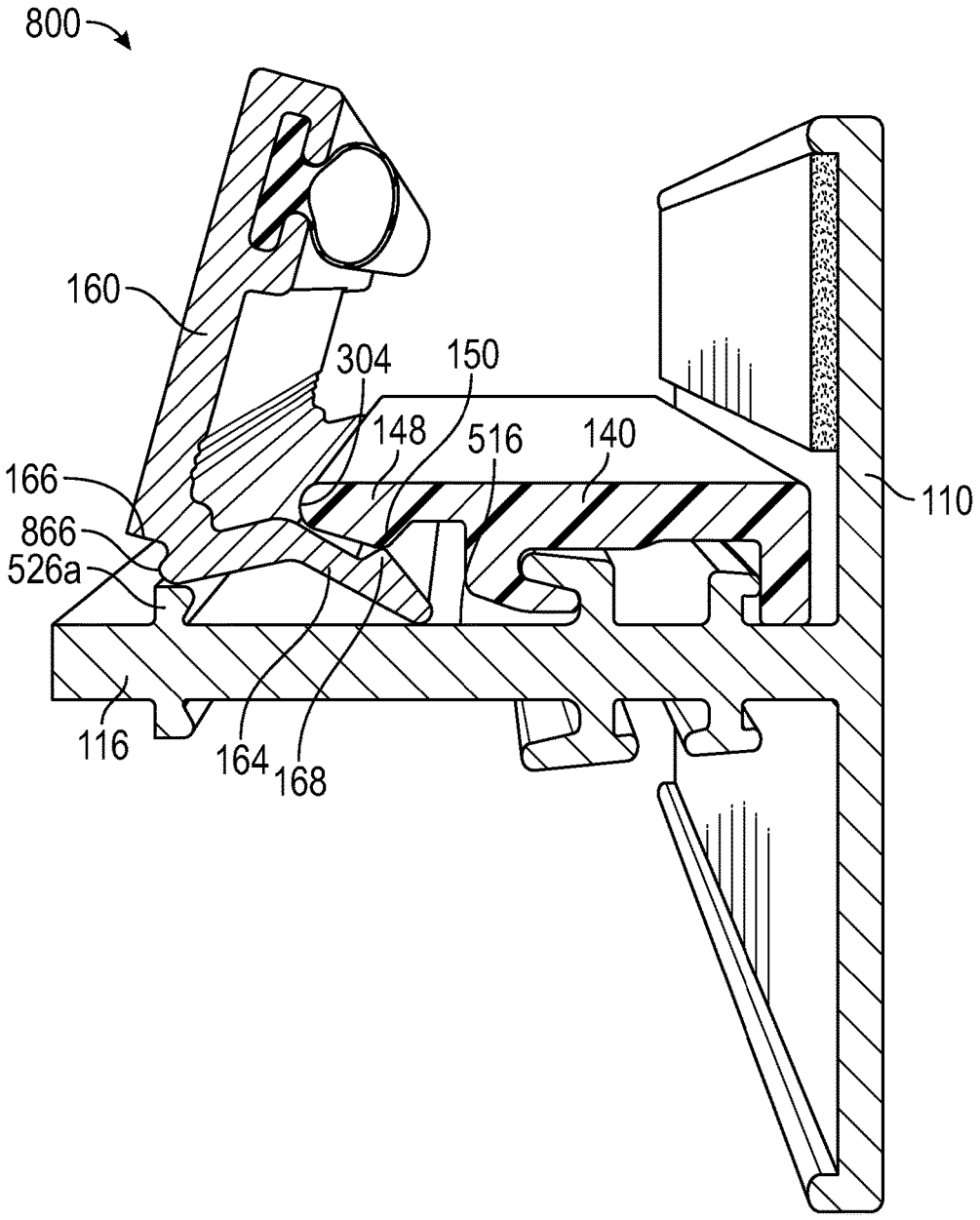
FIG. 8 is an end view demonstrating a third step of the method for assembling the window frame assembly of FIG. 1.

FIG. 8 is an end view demonstrating a third step 800 of the method for assembling the window frame assembly 100 of FIG. 1. In the third step 800, the bead rib 164 can be slipped over the bead clip 526*a* and into the gap 702 (shown in FIG. 7) between the setting block barb 150 of the block lip 148 and the first side 516 of the web 116. The bead rib 164 can define a locking ledge 866 which can be swept towards the bead groove 166, and in the position shown, the locking ledge 866 can rest upon the bead clip 526*a*.

Figure 9:
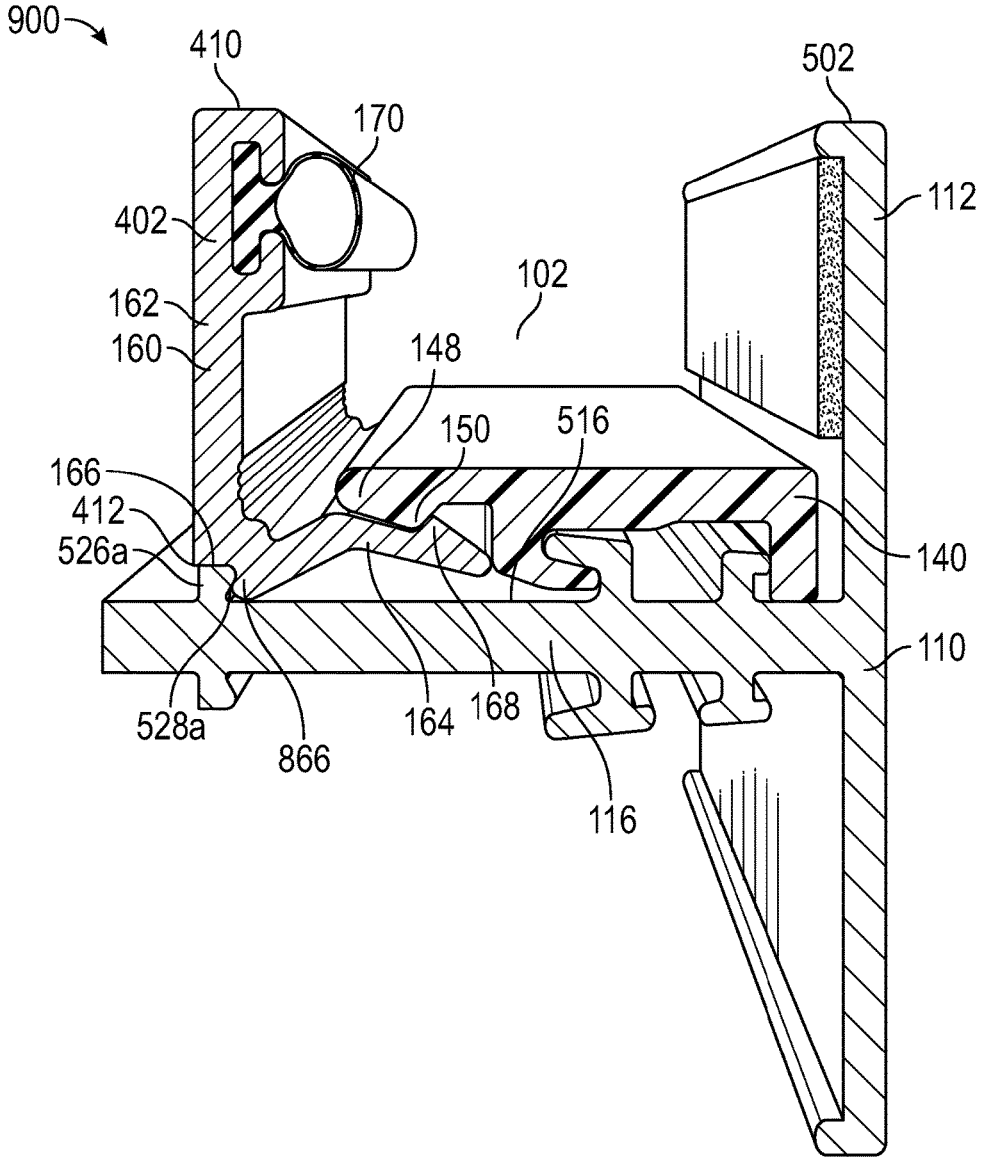
FIG. 9 is an end view demonstrating a fourth step of the method for assembling the window frame assembly of FIG. 1.

FIG. 9 is an end view demonstrating a fourth step 900 of the method for assembling the window frame assembly 100 of FIG. 1. In the fourth step 900, the bead rib 164 can be further inserted between the block lip 148 and the first side 516 of the web 116 until the bead barb 168 slips past the setting block barb 150. In the present aspect, the block lip 148 and the bead rib 164 can elastically deflect so that the bead barb 168 can snap or click past the setting block barb 150, thereby resisting removal of the glazing bead 160 from the frame 110 and the setting block 140. Additionally, the second edge 412 of the bead body 162 can be rocked towards the first side 516 of the web 116 so that the bead clip 526*a* engages the bead groove 166 and the locking ledge 866 engages the acute groove 528*a*. Engagement between the bead clip 526*a* and the bead groove 166 as well as the locking ledge 866 and the acute groove 528*a* can also snap the glazing bead 160 into place, thereby securing the glazing bead 160 to the frame 110 and setting block 140 in a secured position.

The glazing bead 160 can be released by rocking the first edge 410 of the bead body 162 towards the first edge 502 of the flange 114, thereby releasing the bead clip 526*a* from the bead groove 166 and allowing withdrawal of the bead rib 164 from between the block lip 148 and the web 116. However, with the lite 180 (shown in FIG. 1) positioned in the glazing channel 102 as shown in FIG. 1, compression of the bead weather strip 170 resists this rocking motion, thereby biasing the glazing bead 160 towards the secured position.

Figure 10:
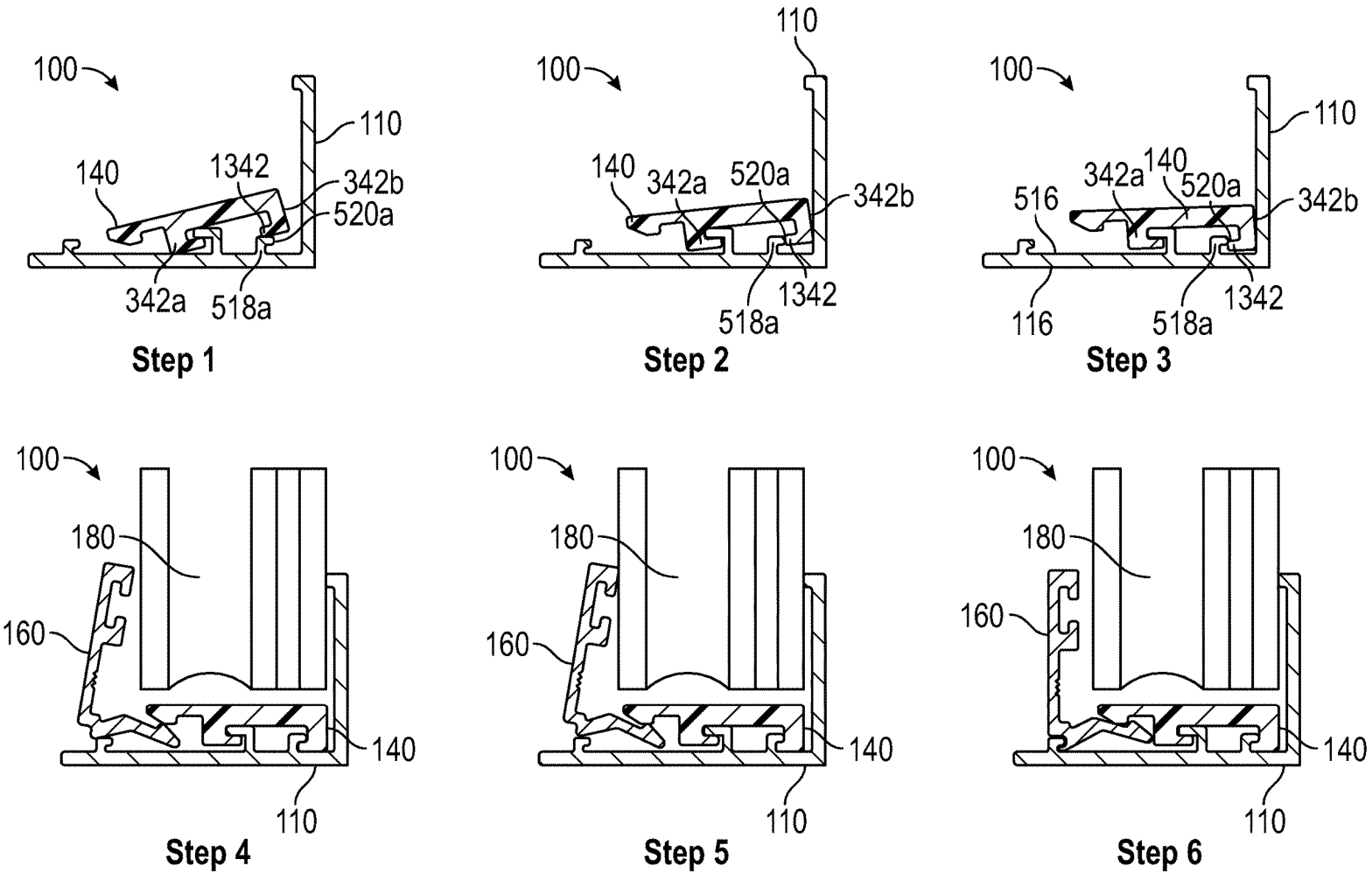
FIG. 10 is an end view of a method for assembling another aspect of the window frame assembly in accordance with another aspect of the present disclosure

FIG. 10 shows an end view of a method for assembling another aspect of the window frame assembly 100 in accordance with another aspect of the present disclosure. The window frame assembly 100 can comprise another aspect of the setting block 140 and another aspect of the frame 110 in accordance with another aspect of the present disclosure. In this aspect of the setting block 140, the block heel rib 342*b* can define the lip 1342 extending towards the block toe rib 342*a*. The lip 1342 can be configured to engage the lip 520*a* of the frame heel rib 518*a*, as shown in Step 1, Step 2, and Step 3. As shown in Step 2 and Step 3, the block heel rib 342*b* can slightly elastically deform as the lip 1342 slips over the lip 520*a*, and the lip 1342 can snap between the lip 520*a* and the first side 516 of the web 116 to secure the setting block 140 to the frame 110. As shown in Step 4, Step 5, and Step 6 and described above with respect to FIGS. 8 and 9, the glazing bead 160 can snap into engagement with the setting block 140 and the frame 110 with a lite 180 positioned between the glazing bead 160 and the frame 110.

The snapping action of the setting block 140 engaging the frame 110 and the glazing bead 160 engaging the frame 110 and the setting block 140 can provide multiple benefits. First, the snapping action provides tactile feedback to an assembler which indicates to the assembler that the components are secured in position. In other window frame assembly designs which do not offer the tactile feedback of the snapping action, it can be unclear to the assembler when the components are properly set, particularly for an inexperienced or new assembler. For example, in some window frame assemblies, glazing beads can be installed by tapping the glazing beads into place with hammer, such as a rubber mallet. In some instances, the assembler may overstress the glazing bead or the lite by continuing to pound on the glazing bead once it has already been set or by pounding excessively hard on the glazing bead. Overstressing the components of other window frame assemblies can lead to failures during assembly, installation, or service. By providing positive tactile feedback that the setting block 140 and glazing bead 160 are properly set, these failures can be prevented.

Similarly, another common point of failure occurs when the assembler of other window frame assembly designs fails to install setting blocks between the lites and frames. In such instances, the assembler may install an inadequate quantity of setting blocks or may entirely forget to install setting blocks at all. Such mistakes place additional stress on the lites which can ultimately lead to failure of the lites in service. With the present window frame assembly 100, if the assembler neglects to install setting blocks 140 into the frame 110, the glazing bead 160 will not snap into and engage the frame 110 without the setting block 140 in place. In such an instance, the absence of positive tactile feedback produced from the improper installation of the glazing bead 160 can alert the assembler that an assembly error has occurred, thereby allowing the assembler to correct the issue before the window frame assembly 100 can leave the shop.

Figure 11:
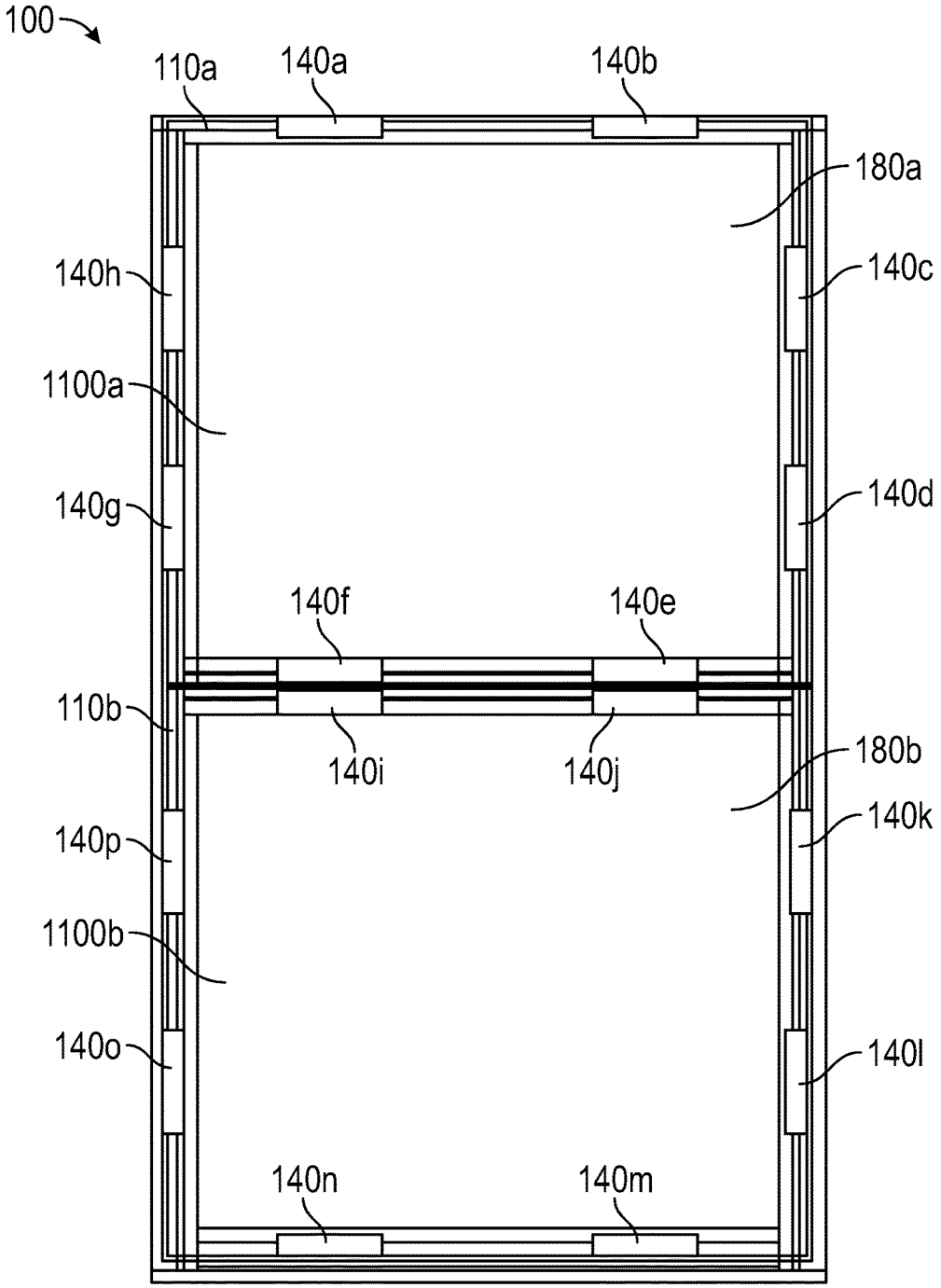
FIG. 11 is a front view of another aspect of the window frame assembly in which the window frame assembly is a single hung window assembly, in accordance with another aspect of the present disclosure.

FIG. 11 is a front view of another aspect of the window frame assembly 100 in which the window frame assembly 100 is a single hung window assembly, in accordance with another aspect of the present disclosure. In the present aspect, the window frame assembly 100 can comprise a fixed window 1100*a* which can be fixed in place and a sash 1100*b* which can be operably moved upwards and downwards in a vertical direction. The frame 110*a* of the fixed window 1100*a* can be a fixed frame, and the frame 110*b* of the sash 1100*b* can be a sash frame. FIG. 11 demonstrates one common configuration for the positioning of the setting blocks 140*a-p* around each respective lite 180*a,b*. In general, two setting blocks 140 can be evenly distributed along each side of each respective lite 180*a,b*; however, this distribution is not limiting. For example, a very large lite or a very heavy lite can have more than two setting blocks 140 positioned along each side. In other aspects, a single setting block 140 can be positioned along each side of each respective lite 180*a,b*. In some of these aspects, each setting block 140 can be extended in length. For example, a single extended setting block 140 can extend over half a width of a side of the respective lite 180*a,b*, for example and without limitation.

Figure 12:
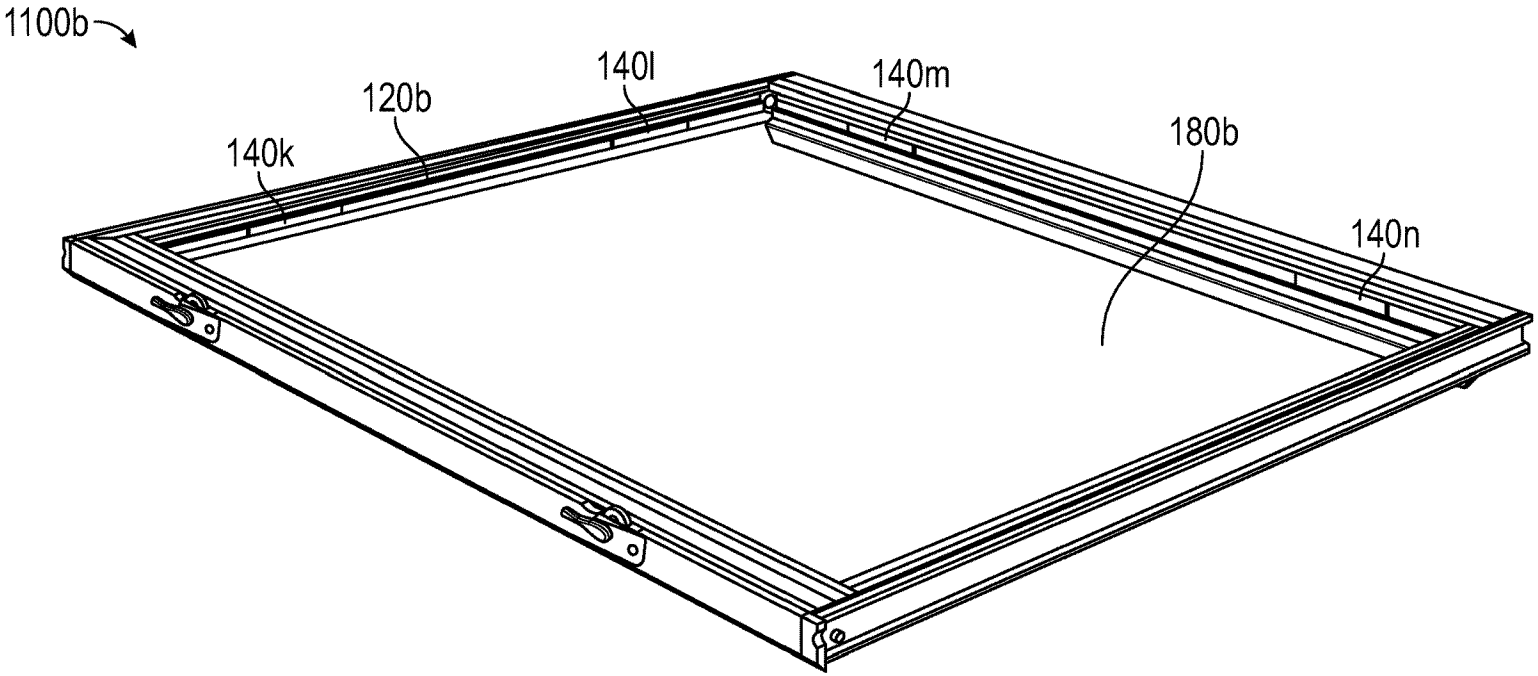
FIG. 12 is a perspective view of a sash of the window frame assembly of FIG. 11.
Figure 13:
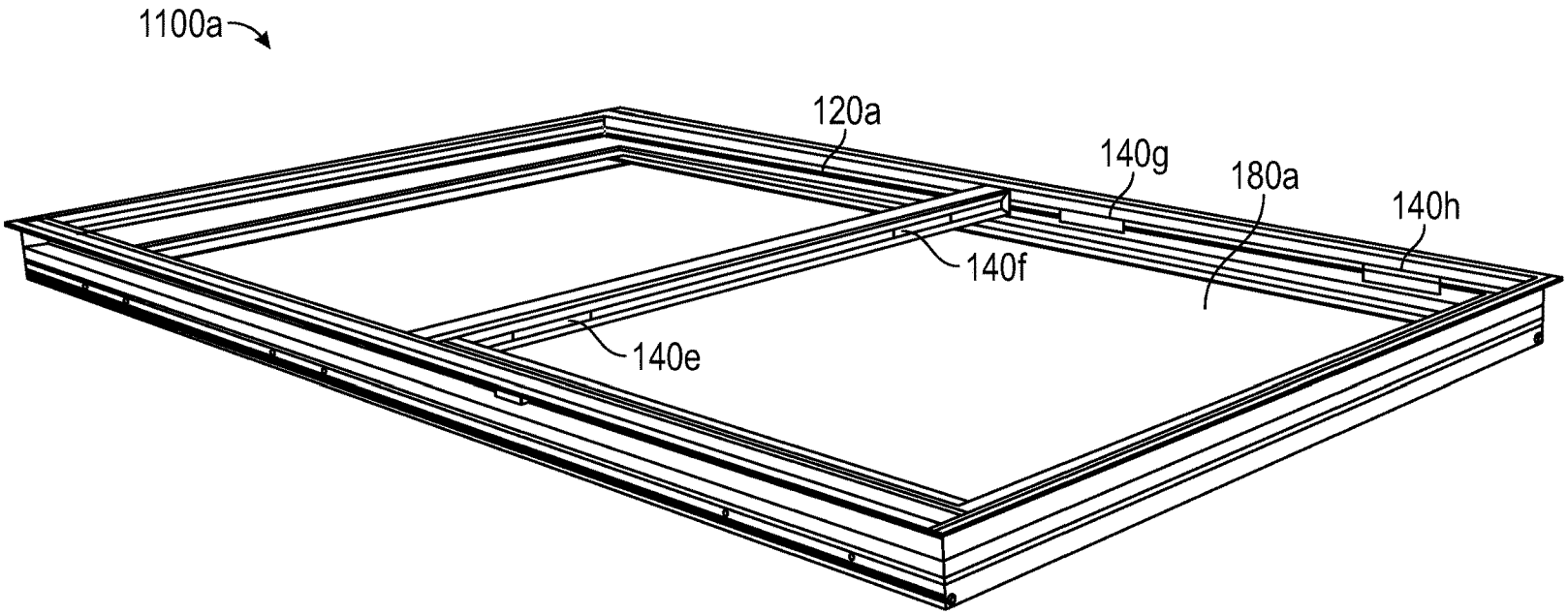
FIG. 13 is a perspective view of a fixed window of the window frame assembly of FIG. 11.

FIG. 12 is a perspective view of the sash 1100*b* of FIG. 11, and FIG. 13 is a perspective view of the fixed window 1100*a* of FIG. 11.

Figure 14:
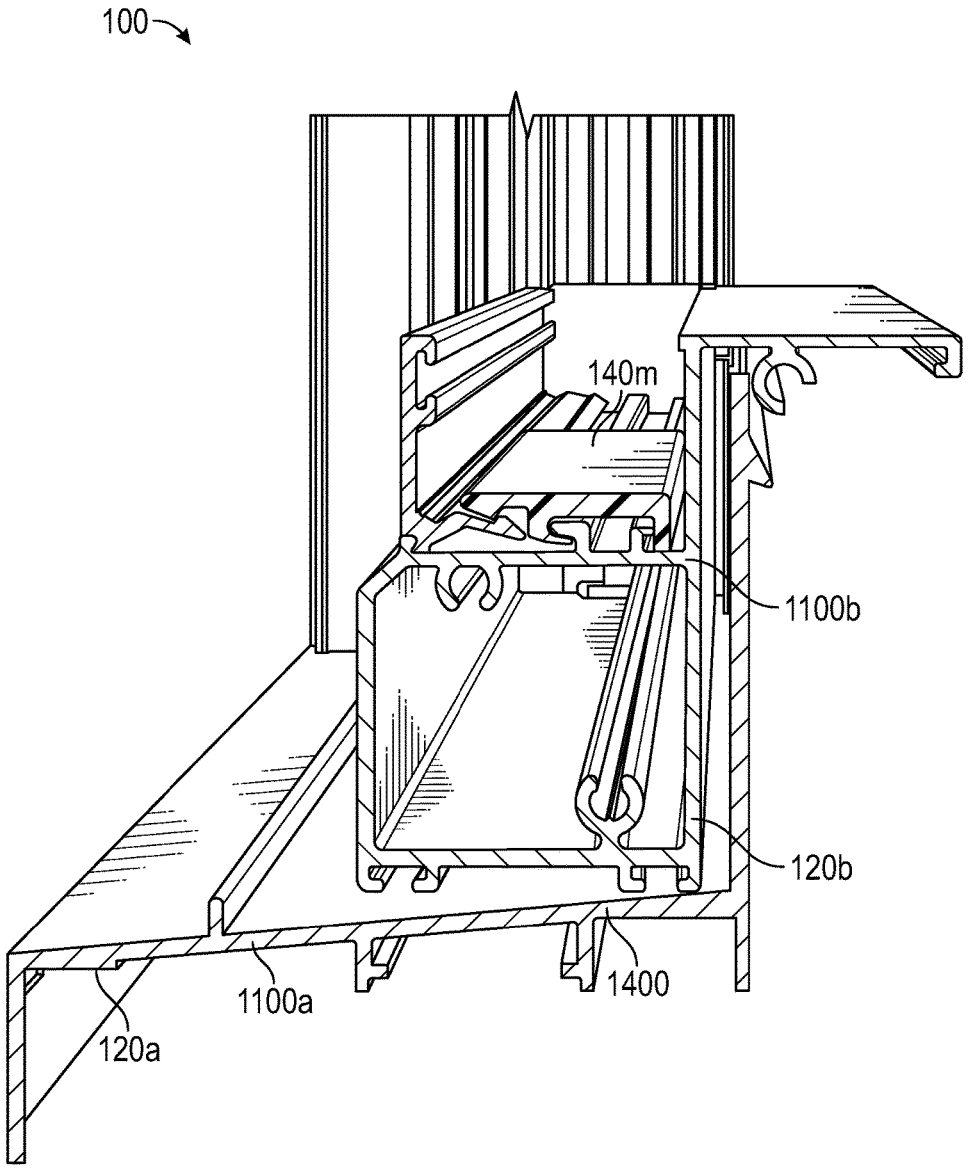
FIG. 14 is a perspective cross-sectional view of the window frame assembly of FIG. 11 showing the sash closed against a sill of a frame of the fixed window.
Figure 15:
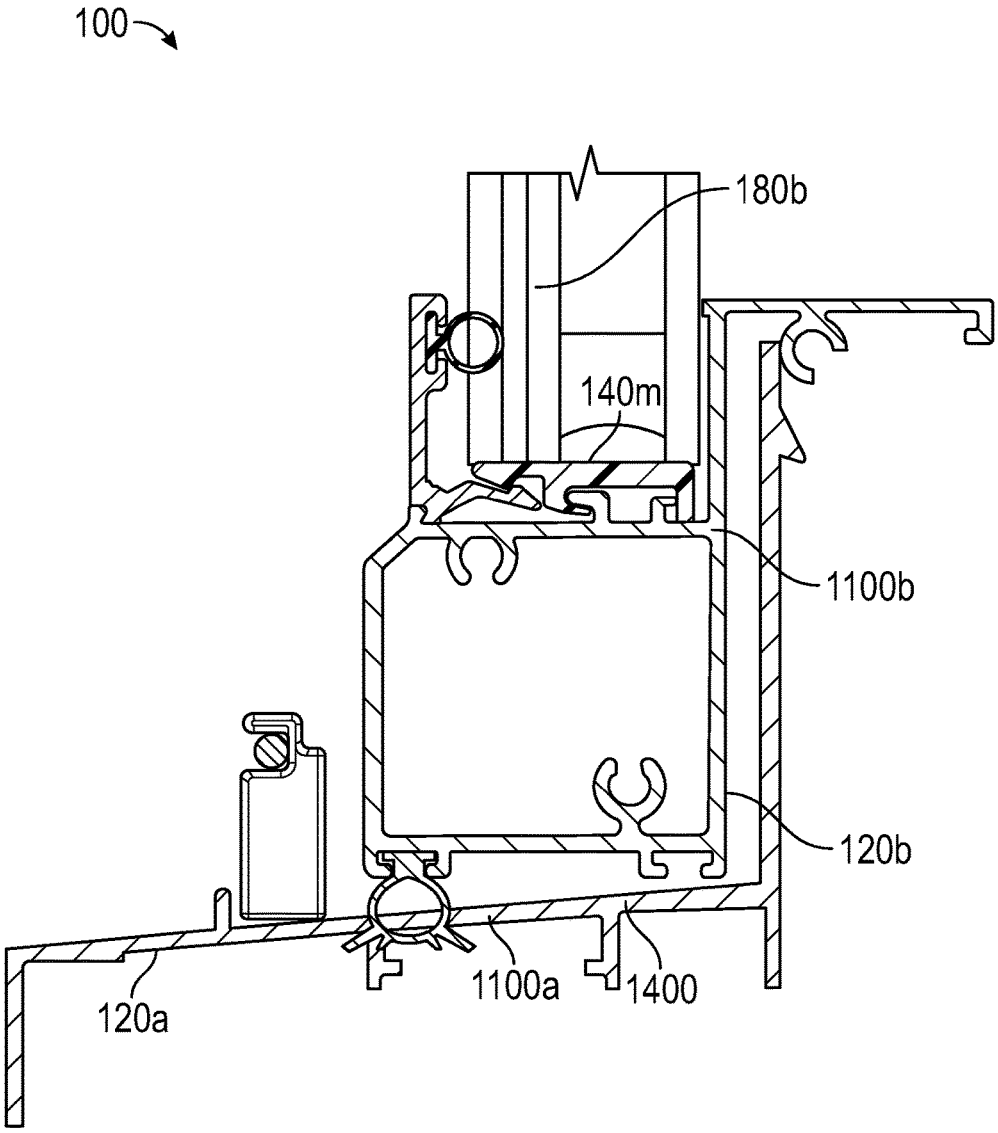
FIG. 15 is a side cross-sectional view of the window frame assembly of FIG. 11 showing the sash closed against the sill of the frame of the fixed window.

FIG. 14 is a perspective cross-sectional view of the window frame assembly 100 of FIG. 11 showing the sash 1100*b* closed against a sill 1400 of the frame 120*a* of the fixed window 1100*a*. FIG. 15 is a side cross-sectional view of the window frame assembly 100 of FIG. 11 showing the sash 1100*b* closed against the sill 1400 of the frame 120*a* of the fixed window 1100*a*.

Figure 16:
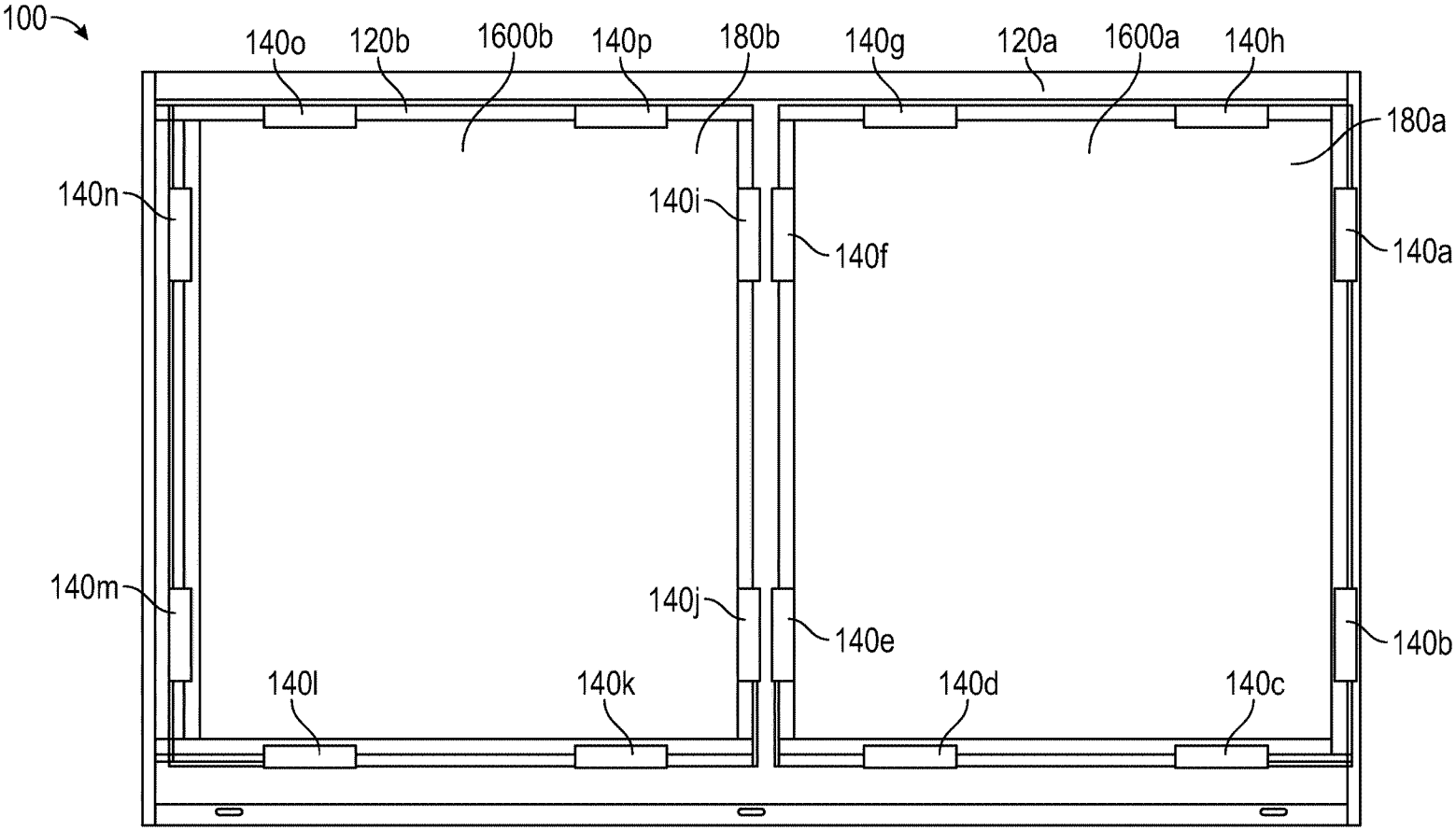
FIG. 16 is a front view of another aspect of the window frame assembly in which the window frame assembly is a horizontal sliding window assembly, in accordance with another aspect of the present disclosure.

FIG. 16 is a front view of another aspect of the window frame assembly 100 in which the window frame assembly 100 is a horizontal sliding window assembly, in accordance with another aspect of the present disclosure. In the present aspect, the window frame assembly 100 can comprise a fixed window 1600*a* which can be fixed in place and a sash 1600*b* which can be operably moved side to side in a horizontal direction. The frame 110*a* of the fixed window 1600*a* can be a fixed frame, and the frame 110*b* of the sash 1600*b* can be a sash frame. The sash 1600*b* can ride within the frame 120*a* of the fixed window 1600*a*. Similar to FIG. 11, FIG. 16 demonstrates one common configuration for the positioning of the setting blocks 140*a-p* around each respective lite 180*a,b*. In general, two setting blocks 140 can be evenly distributed along each side of each respective lite 180*a,b*; however, this distribution is not limiting. For example, a very large lite or a very heavy lite can have more than two setting blocks 140 positioned along each side. In other aspects, a single setting block 140 can be positioned along each side of each respective lite 180*a,b*. In some of these aspects, each setting block 140 can be extended in length. For example, a single extended setting block 140 can extend over half a width of a side of the respective lite 180*a,b*, for example and without limitation.

Figure 17:
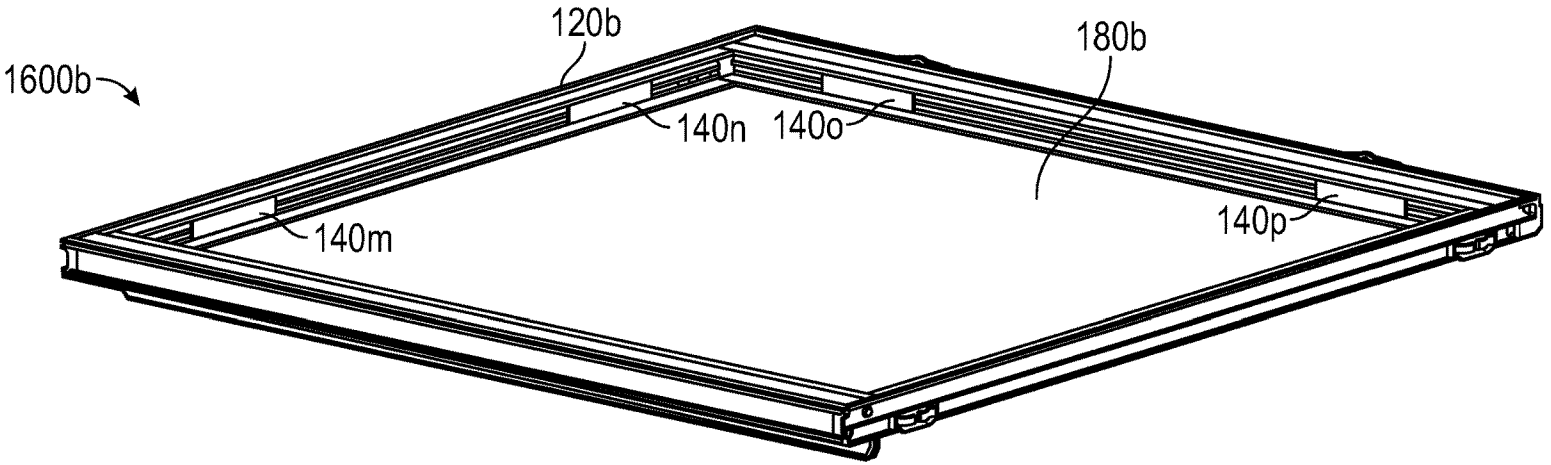
FIG. 17 is a perspective view of a sash of the window frame assembly of FIG. 16.
Figure 18:
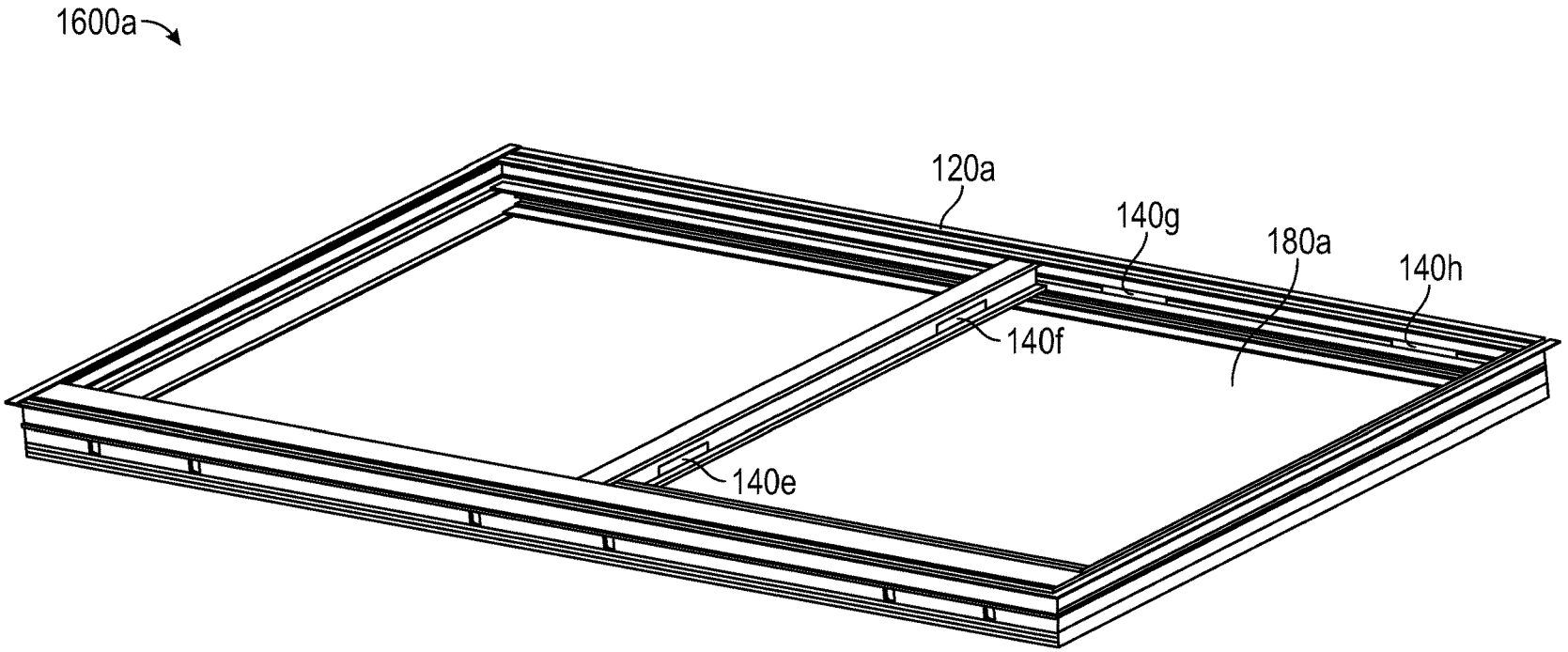
FIG. 18 is a perspective view of a fixed window of the window frame assembly of FIG. 16.

FIG. 17 is a perspective view of the sash 1600*b* of FIG. 16, and FIG. 18 is a perspective view of the fixed window 1600*a* of FIG. 16.

Figure 19:
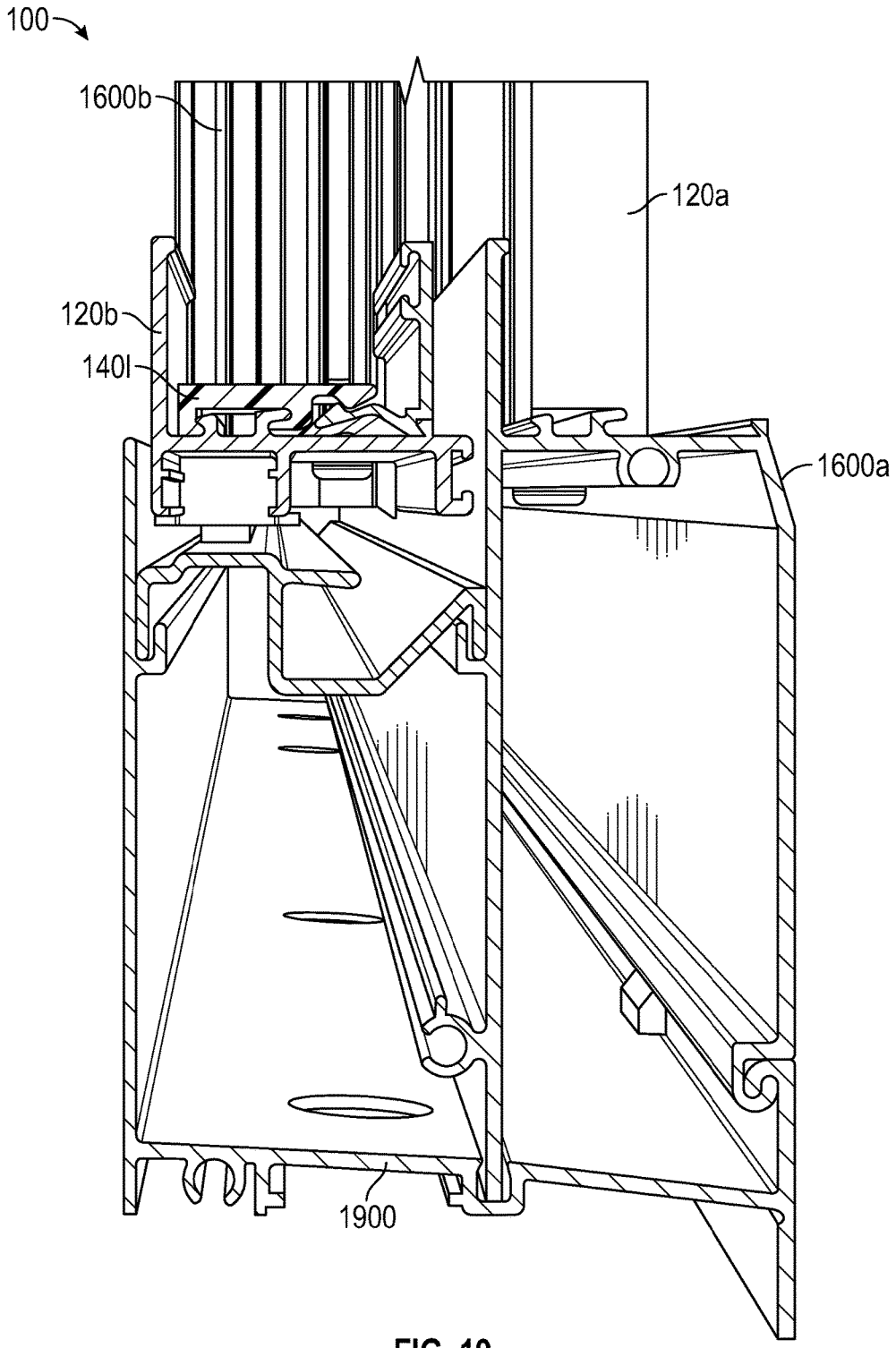
FIG. 19 is a perspective cross-sectional view of the window frame assembly of FIG. 16 showing the sash guided by a sill of a frame of the fixed window.
Figure 20:
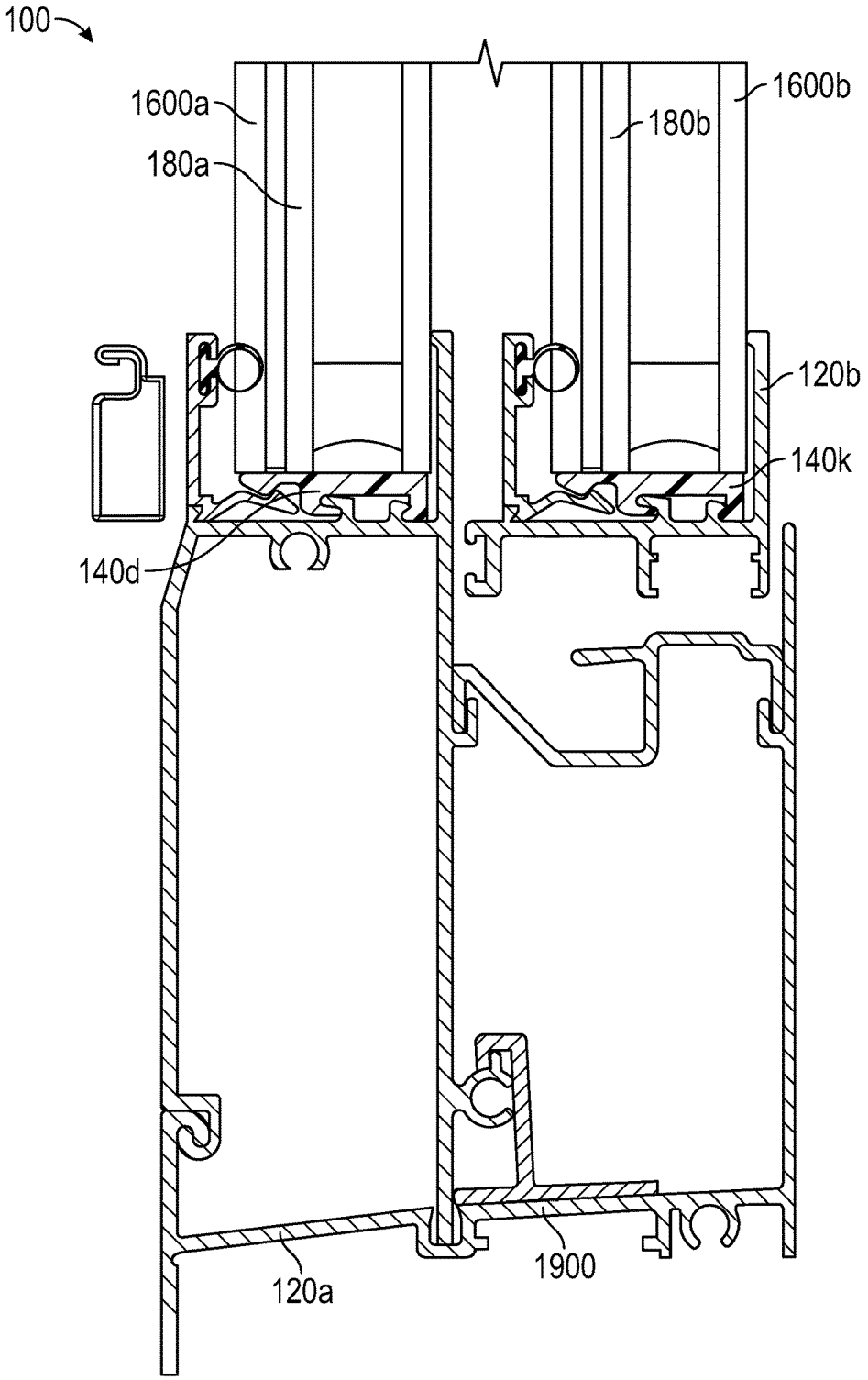
FIG. 20 is a side cross-sectional view of the window frame assembly of FIG. 16 showing the sash guided by the sill of the frame of the fixed window.

FIG. 19 is a perspective cross-sectional view of the window frame assembly 100 of FIG. 16 showing the sash 1600*b* guided by a sill 1900 of the frame 120*a* of the fixed window 1600*a*. FIG. 20 is a side cross-sectional view of the window frame assembly 100 of FIG. 16 showing the sash 1600*b* guided by the sill 1900 of the frame 120*a* of the fixed window 1600*a*.

Figure 21:
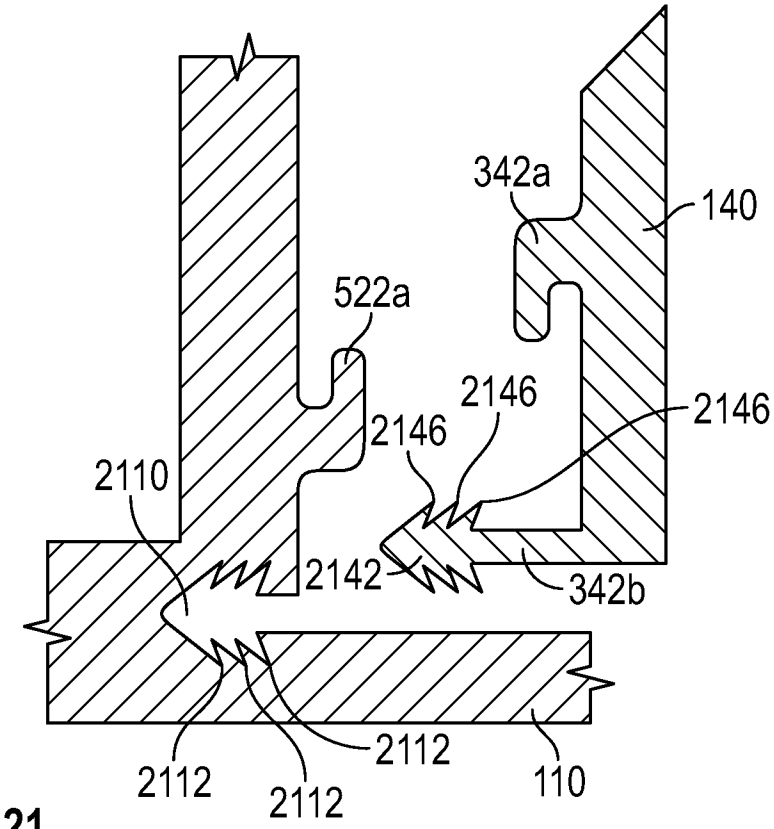
FIG. 21 shows a side cross-sectional view of another aspect of the setting block and another aspect of the frame in accordance with the present disclosure.
Figure 21:
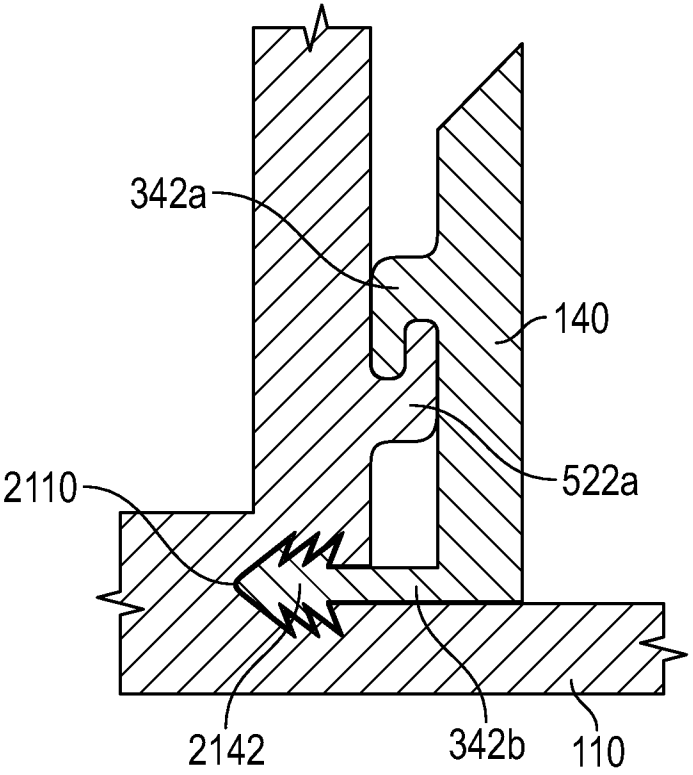

FIG. 21 is a side cross-sectional view of another aspect of the setting block 140 and another aspect of the frame 110 in accordance with the present disclosure. In the present aspect, the setting block 140, the block heel rib 342*b* can comprise a heel barb 2142. The heel barb 2142 can define at least one spur 2146 extending outwards and away from the block heel rib 342*b*. Rather than defining the frame heel rib 518*a* (shown in FIG. 6), the frame 110 can define a kerf 2110 configured to receive the heel barb 2142. The kerf 2110 can define at least one groove 2112 within the kerf 2110 which can be sized and shaped to receive the plurality of spurs 2146 of the heel barb 2142 to secure the block heel rib 342*b* to the frame 110. The number of spurs 2146 and grooves 2112 should not be viewed as limiting.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A window frame assembly comprising:
a frame;
a setting block comprising:
a block body secured to the frame; and
a block lip extending outwards from the block body;
a glazing bead secured to the frame and the setting block, a bead rib of the glazing bead positioned between the block lip and the frame, the glazing bead and the frame defining a glazing channel; and
a lite defining a first edge, the first edge of the lite inserted into the glazing channel; and
wherein the block lip is positioned between the first edge of the lite and the bead rib of the glazing bead.

2. The window frame assembly of claim 1, wherein:
the block lip defines a setting block barb;
the bead rib defines a bead barb; and
the bead barb engages the setting block barb.

3. The window frame assembly of claim 2, wherein:
the glazing bead defines a bead groove opposite from the bead barb;
the bead groove receives a bead clip defined by the frame; and
engagement between the bead groove and the bead clip secures the glazing bead to the setting block and the frame.

4. The window frame assembly of claim 1, wherein:
the setting block comprises a heel barb;
the frame defines a kerf; and
the kerf receives the heel barb.

5. The window frame assembly of claim 4, wherein:
the heel barb defines at least one spur;
the kerf defines at least one groove; and
the at least one groove receives the at least one spur.

6. A method for assembling a window frame assembly, the method comprising:
securing a setting block of the window frame assembly to a frame of the window frame assembly; and
securing a glazing bead of the window frame assembly to the setting block and to the frame; and
wherein securing the setting block of the window frame assembly to the frame of the window frame assembly comprises:
engaging a frame toe rib of the frame with a block toe rib of the setting block; and
engaging a frame heel rib of the frame with a block heel rib of the setting block.

7. The method of claim 6, wherein engaging the frame heel rib of the frame with the block heel rib of the setting block comprises pivoting a first edge of the setting block towards a web of the frame, the block heel rib disposed proximate to the first edge, the frame heel rib defined by the web.

8. The method of claim 6, wherein securing the glazing bead of the window frame assembly to the setting block and to the frame comprises:
inserting a bead rib of the glazing bead into a gap defined between the setting block and the frame; and
engaging a bead clip of the frame with a bead groove of the glazing bead.

9. The method of claim 8, wherein engaging the bead clip of the frame with the bead groove of the glazing bead comprises rocking an edge of the glazing bead towards a web of the frame.

10. The method of claim 6, wherein securing the glazing bead of the window frame assembly to the setting block and to the frame comprises engaging a bead barb of the glazing bead with a block barb of the setting block.

11. The method of claim 6, further comprising inserting a first edge of a lite into a glazing channel defined by the glazing bead and the frame, the setting block disposed in the glazing channel.

12. A window frame assembly comprising:
a frame; and
a setting block, the setting block configured to engage the frame; and
wherein:
the frame comprises a frame toe rib and a frame heel rib;
the setting block defines a setting block groove;
the frame toe rib and the frame heel rib engage the setting block groove; and
the setting block is secured to the frame.

13. The window frame assembly of claim 12, wherein:
the setting block comprises a block toe rib and a block heel rib;
the block toe rib engages the frame toe rib; and
the block heel rib engages the frame heel rib.

14. The window frame assembly of claim 13, wherein:
the block heel rib defines a block lip;
the frame heel rib defines a frame lip; and
the block lip of the block heel rib is positioned between the frame lip of the frame heel rib and the frame.

15. The window frame assembly of claim 12, further comprising a glazing bead, the glazing bead engaging the frame and the setting block, the glazing bead and the setting block secured to the frame.

16. The window frame assembly of claim 15, wherein:
the setting block comprises a block lip;
the glazing bead comprises a bead rib; and
the bead rib extends between the block lip and the frame and engages the block lip.

17. The window frame assembly of claim 15, wherein:
the frame and the glazing bead define a glazing channel;
the window frame assembly further comprises a lite; and
a first edge of the lite is received and secured within the glazing channel between the frame and the glazing bead.

18. A window frame assembly comprising:
a frame;
a setting block comprising:
a block body secured to the frame; and
a block lip extending outwards from the block body;
a glazing bead secured to the frame and the setting block,
a bead rib of the glazing bead positioned between the block lip and the frame, the glazing bead and the frame defining a glazing channel; and
a lite defining a first edge, the first edge of the lite inserted into the glazing channel; and
wherein:
the block lip defines a setting block barb;
the bead rib defines a bead barb; and
the bead barb engages the setting block barb;
the glazing bead defines a bead groove opposite from the bead barb;
the bead groove receives a bead clip defined by the frame; and
engagement between the bead groove and the bead clip secures the glazing bead to the setting block and the frame.

19. A method for assembling a window frame assembly, the method comprising:
securing a setting block of the window frame assembly to a frame of the window frame assembly; and
securing a glazing bead of the window frame assembly to the setting block and to the frame; and
wherein securing the glazing bead of the window frame assembly to the setting block and to the frame comprises:
inserting a bead rib of the glazing bead into a gap defined between the setting block and the frame; and
engaging a bead clip of the frame with a bead groove of the glazing bead.

20. The method of claim 19, wherein engaging the bead clip of the frame with the bead groove of the glazing bead comprises rocking an edge of the glazing bead towards a web of the frame.

* * * * *